US011724512B2

(12) United States Patent
Nakata et al.

(10) Patent No.: US 11,724,512 B2
(45) Date of Patent: Aug. 15, 2023

(54) LIQUID CIRCULATION MECHANISM, LIQUID CIRCULATION DEVICE, AND LIQUID DISCHARGING APPARATUS

(71) Applicant: SEIKO EPSON CORPORATION, Tokyo (JP)

(72) Inventors: Toshio Nakata, Matsumoto (JP); Yuichi Urabe, Shiojiri (JP); Hisashi Sato, Shiojiri (JP); Sawako Tsujimura, Shiojiri (JP); Shinji Hirata, Shiojiri (JP); Yoshiaki Kishii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/649,098

(22) Filed: Jan. 27, 2022

(65) Prior Publication Data

US 2022/0242135 A1 Aug. 4, 2022

(30) Foreign Application Priority Data

Jan. 29, 2021 (JP) ..... JP2021-012851

(51) Int. Cl.
*B41J 2/175* (2006.01)

(52) U.S. Cl.
CPC ..... *B41J 2/17596* (2013.01)

(58) Field of Classification Search
CPC . B41J 2/18; B41J 2/17596; B41J 29/13; B41J 2/17509
See application file for complete search history.

(56) References Cited

U.S. PATENT DOCUMENTS

| | | | | |
|---|---|---|---|---|
| 9,242,475 | B2 * | 1/2016 | Otsuka | B41J 2/19 |
| 10,160,225 | B2 * | 12/2018 | Koike | B41J 2/17506 |
| 11,077,671 | B2 * | 8/2021 | Wakasa | B41J 2/18 |
| 2010/0085396 | A1 * | 4/2010 | Yokota | B41J 2/14233 347/17 |
| 2015/0183227 | A1 | 7/2015 | Ishikawa | |

FOREIGN PATENT DOCUMENTS

JP 2017-159668 A 9/2017

* cited by examiner

*Primary Examiner* — An H Do
(74) *Attorney, Agent, or Firm* — Workman Nydegger

(57) ABSTRACT

A liquid circulation mechanism includes a first storage portion configured to store liquid to be supplied to a liquid discharging head, a second storage portion configured to store the liquid collected from the liquid discharging head, a third storage portion configured to store the liquid between the second storage portion and the first storage portion, a first check valve allowing flow of the liquid from the second storage portion to the third storage portion while regulating flow of the liquid from the third storage portion to the second storage portion, in the second collection flow path, and a second check valve allowing flow of the liquid from the third storage portion to the first storage portion while regulating flow of the liquid from the first storage portion to the third storage portion, in the third collection flow path.

19 Claims, 16 Drawing Sheets

FIG. 14

| OPENING/CLOSING VALVE | PRESSURE | NORMAL CIRCULATION | HIGH-SPEED CIRCULATION | NOZZLE AIR EXHAUST | WIPING | NEGLECTING TIME |
|---|---|---|---|---|---|---|
| FIRST POSITIVE PRESSURE OPENING/CLOSING VALVE | LOW | OPEN | CLOSE | CLOSE | CLOSE | CLOSE |
| SECOND POSITIVE PRESSURE OPENING/CLOSING VALVE | HIGH | CLOSE | OPEN | OPEN | CLOSE | CLOSE |
| FIRST NEGATIVE PRESSURE OPENING/CLOSING VALVE | LOW | OPEN | CLOSE | CLOSE | CLOSE | OPEN |
| SECOND NEGATIVE PRESSURE OPENING/CLOSING VALVE | HIGH | CLOSE | OPEN | CLOSE | CLOSE | CLOSE |

LIQUID CIRCULATION MECHANISM, LIQUID CIRCULATION DEVICE, AND LIQUID DISCHARGING APPARATUS

The present application is based on, and claims priority from JP Application Serial Number 2021-012851, filed Jan. 29, 2021, the disclosure of which is hereby incorporated by reference herein in its entirety.

BACKGROUND

1. Technical Field

The present disclosure relates to a liquid circulation mechanism, a liquid circulation device, and a liquid discharging apparatus including a supply flow path for supplying liquid in a liquid supply source to a liquid discharging head and a collection flow path for collecting the liquid in the liquid discharging head to the supply flow path.

2. Related Art

For example, as in JP-A-2017-159668, in a liquid discharging apparatus including a liquid discharging head for discharging liquid, a liquid circulation mechanism is disclosed that circulates liquid for supplying the liquid to the liquid discharging head by using a supply flow path for supplying the liquid in a liquid supply source to the liquid discharging head and a collection flow path for collecting the liquid from the liquid discharging head to the supply flow path.

In such a liquid circulation mechanism, at least any one of the supply flow path and the collection flow path is provided with a pump for circulating the liquid and a pressure adjustment portion, which opens a flow path when a pressure on the liquid discharging head side is equal to a predetermined pressure. As a result, the liquid can be circulated at a predetermined flow rate.

However, in such a liquid circulation mechanism, it is necessary to dispose a pump for circulating liquid on at least any one of the flow paths of the supply flow path and the collection flow path, which may lead to an increase in size.

SUMMARY

To solve the above problems, a liquid circulation mechanism includes: a first storage portion configured to store liquid to be supplied to a liquid discharging head that discharges the liquid; a supply flow path making the first storage portion and the liquid discharging head communicate with each other; a second storage portion configured to store the liquid collected from the liquid discharging head; a first collection flow path making the liquid discharging head and the second storage portion communicate with each other; a third storage portion configured to store the liquid between the second storage portion and the first storage portion; a second collection flow path making the second storage portion and the third storage portion communicate with each other; a third collection flow path making the third storage portion and the first storage portion communicate with each other; a first check valve allowing flow of the liquid from the second storage portion to the third storage portion while regulating flow of the liquid from the third storage portion to the second storage portion, in the second collection flow path; and a second check valve allowing flow of the liquid from the third storage portion to the first storage portion while regulating flow of the liquid from the first storage portion to the third storage portion, in the third collection flow path.

To solve the above problems, a liquid circulation device includes: a liquid circulation mechanism having a first storage portion configured to store liquid to be supplied to a liquid discharging head that discharges the liquid, a supply flow path making the first storage portion and the liquid discharging head communicate with each other, a second storage portion configured to store the liquid collected from the liquid discharging head, a first collection flow path making the liquid discharging head and the second storage portion communicate with each other, a third storage portion configured to store the liquid between the second storage portion and the first storage portion, a second collection flow path making the second storage portion and the third storage portion communicate with each other, a third collection flow path making the third storage portion and the first storage portion communicate with each other, a first check valve allowing flow of the liquid from the second storage portion to the third storage portion while regulating flow of the liquid from the third storage portion to the second storage portion, in the second collection flow path, and a second check valve allowing flow of the liquid from the third storage portion to the first storage portion while regulating flow of the liquid from the first storage portion to the third storage portion, in the third collection flow path; and a circulation device having a depressurization portion configured to depressurize the second storage portion and the third storage portion, a depressurization switching portion configured to switch at least between a first depressurization state, in which the depressurization portion and the second storage portion communicate with each other, and a second depressurization state, in which the depressurization portion and the third storage portion communicate with each other, a pressurization portion configured to pressurize the third storage portion and the first storage portion, and a pressurization switching portion configured to switch at least between a first pressurization state, in which the pressurization portion and the first storage portion communicate with each other, and a second pressurization state, in which the pressurization portion and the third storage portion communicate with each other.

A liquid discharging apparatus that solves the above problems includes a liquid discharging head that discharges liquid, the liquid circulation device described above, and a control portion that controls the liquid discharging head and the liquid circulation device.

BRIEF DESCRIPTION OF THE DRAWINGS

FIG. 14 is a schematic view illustrating the content of a control of the liquid discharging apparatus.

DESCRIPTION OF EXEMPLARY EMBODIMENTS

Figure 1:
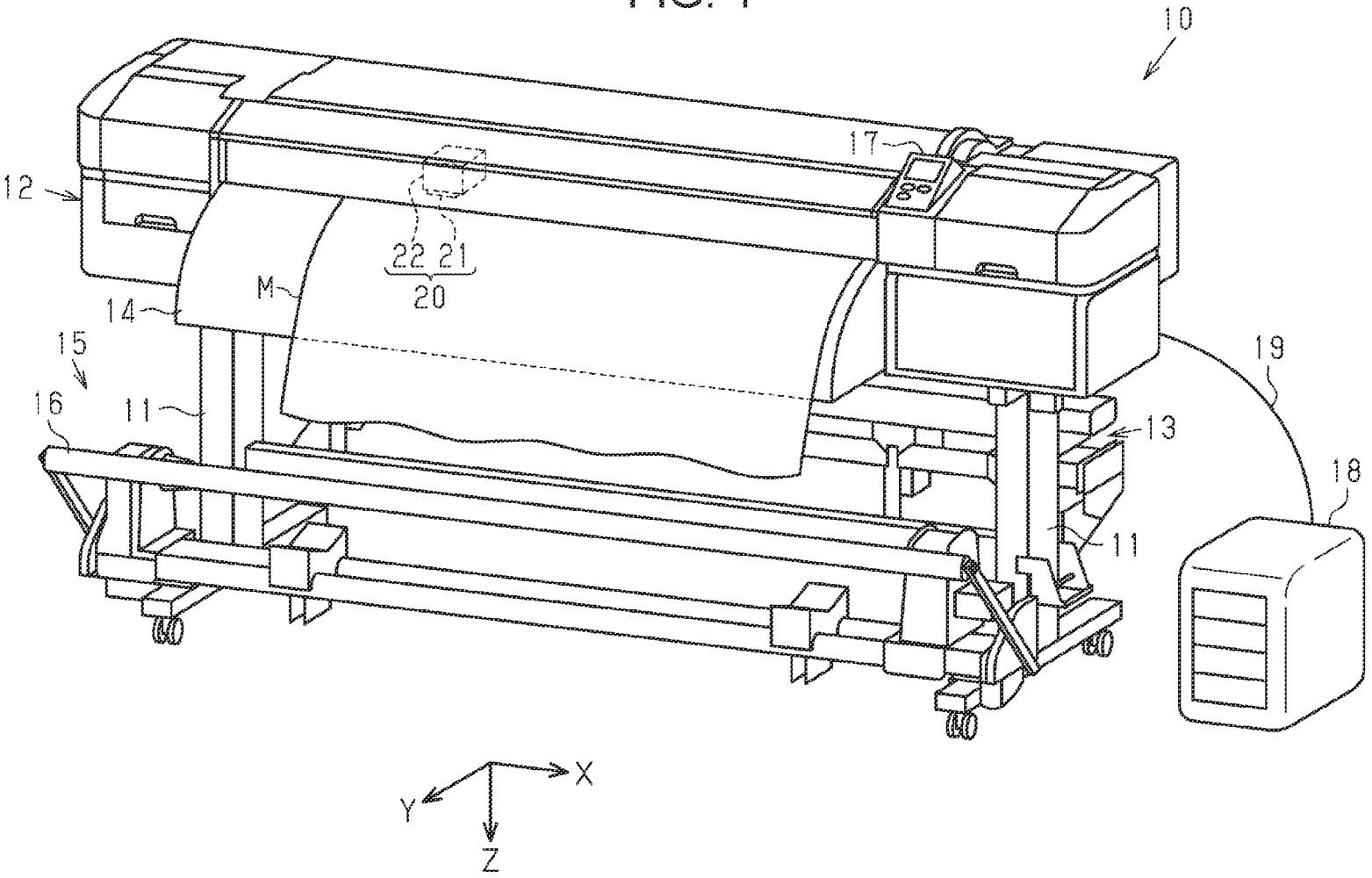
FIG. 1 is a perspective view of an embodiment of a liquid discharging apparatus.

Hereinafter, an embodiment of a liquid circulation mechanism, a liquid circulation device, and a liquid discharging apparatus will be described with reference to the drawings. In the present embodiment, the liquid circulation mechanism and the liquid circulation device are mounted on the liquid discharging apparatus that discharges liquid such as ink to a medium such as a paper. In the present embodiment, the liquid discharging apparatus is mounted on, for example, an ink jet type large format printer that discharges the ink onto long paper to print.

In the drawings, the direction of gravity is indicated by the Z axis, and the directions along the surfaces intersecting the Z axis are indicated by the X axis and the Y axis, assuming that the liquid discharging apparatus 10 is placed on a horizontal plane. The X axis and Y axis are along the horizontal plane when the X axis, Y axis, and Z axis are orthogonal to each other. In the following description, the direction along the X axis is also referred to as the width direction X, the direction along the Y axis is also referred to as the depth direction Y, and the direction along the Z axis is also referred to as the vertical direction Z.

As illustrated in FIG. 1, the liquid discharging apparatus 10 includes a pair of leg portions 11 and a housing 12. The housing 12 is assembled on the leg portions 11.

The liquid discharging apparatus 10 includes a feeding portion 13, a guide plate 14, a winding portion 15, a tension applying mechanism 16, and an operation panel 17. The feeding portion 13 feeds a medium M, which is wound around a roll body, toward the inside of the housing 12. The guide plate 14 guides the medium M that is exhausted from the housing 12. The winding portion 15 winds the medium M, which is guided by the guide plate 14, onto the roll body. The tension applying mechanism 16 applies tension to the medium M wound around the winding portion 15. The operation panel 17 is operated by a user.

The liquid discharging apparatus 10 includes a printing portion 20. The printing portion 20 is provided in the housing 12. The printing portion 20 includes a liquid discharging head 21 and a carriage 22. The liquid discharging head 21 discharges liquid. The liquid discharging head 21 is mounted on the carriage 22.

The liquid discharging apparatus 10 includes a liquid supply source 18. The liquid supply source 18 is provided outside the housing 12. The liquid supply source 18 is a supply source for supplying the liquid to the printing portion 20. The liquid supply source 18 is, for example, a container for accommodating the liquid. The liquid supply source 18 may be a replaceable cartridge or a tank capable of replenishing with the liquid. Further, for example, the liquid supply source 18 may be provided in the housing 12 or may be provided separately from the liquid discharging apparatus 10, for example. The liquid supply source 18 includes a plurality of supply sources so as to correspond to the type of liquid discharged from the liquid discharging head 21. The liquid supply source 18 of the present embodiment includes four supply sources.

The liquid discharging apparatus 10 includes a supply flow path 19. The supply flow path 19 is a flow path for supplying the liquid from the liquid supply source 18 to the printing portion 20 in order to supply the liquid to the printing portion 20. The supply flow path 19 includes a plurality of flow paths so as to correspond to the type of liquid discharged from the liquid discharging head 21. The supply flow path 19 of the present embodiment includes four flow paths. When there is only one type of liquid discharged from the liquid discharging head 21, the liquid discharging apparatus 10 may include one supply flow path 19.

Figure 2:
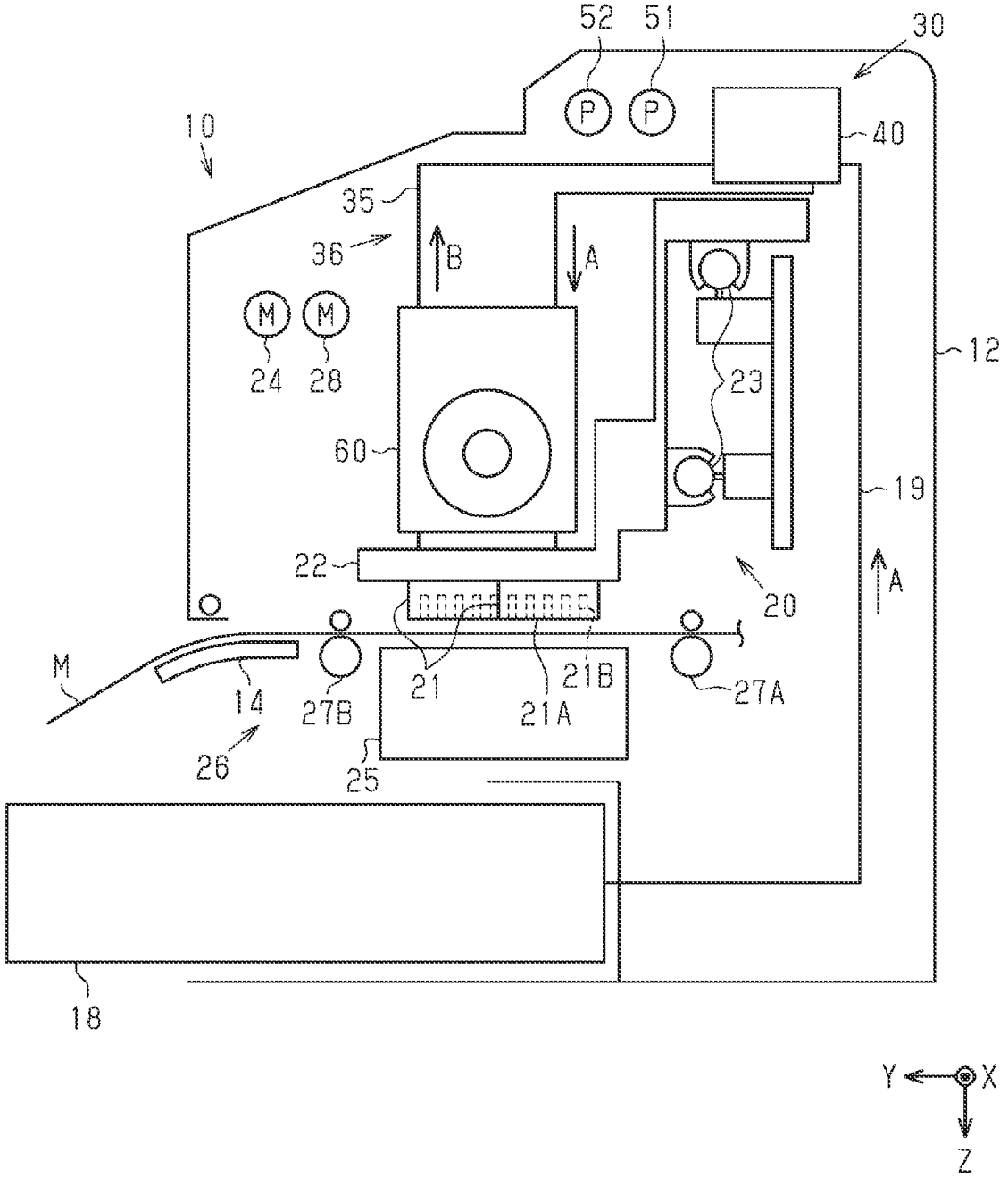
FIG. 2 is a schematic view illustrating an internal configuration of the liquid discharging apparatus.

Next, the internal configuration of the liquid discharging apparatus 10 will be described with reference to FIG. 2. In FIG. 2, only the configuration of one system, among the configurations of a plurality of systems, corresponding to the type of liquid discharged from the liquid discharging head 21 is illustrated as a representative.

As illustrated in FIG. 2, the printing portion 20 includes a guide shaft 23. The guide shaft 23 guides the carriage 22 in the width direction X. The carriage 22 is configured to be capable of reciprocating movement in the width direction X as a carriage motor 24 is driven. In the present embodiment, the width direction X is also referred to as the main scanning direction.

The liquid discharging head 21 is attached to a lower end portion of the carriage 22. The printing portion 20 may include a plurality of liquid discharging heads 21. The liquid discharging head 21 discharges the liquid from a plurality of nozzles 21B, which are formed on a nozzle surface 21A, and prints the liquid on the medium M.

The liquid discharging apparatus 10 includes a support base 25 and a transport portion 26. The support base 25 is disposed at a position facing the liquid discharging head 21. The transport portion 26 transports the medium M in the depth direction Y. The transport portion 26 includes a first pair of transporting rollers 27A and a second pair of transporting rollers 27B. The first pair of transporting rollers 27A is positioned more upstream than the support base 25 in the depth direction Y. The second pair of transporting rollers 27B is positioned more downstream than the support base 25 in the depth direction Y. The first pair of transporting rollers 27A and the second pair of transporting rollers 27B are driven by a transporting motor 28 and rotated. The first pair of transporting rollers 27A and the second pair of transporting rollers 27B transport the medium M along a surface of the support base 25 and a surface of the guide plate 14 by rotating while interposing the medium M. In the present embodiment, the depth direction Y is also referred to as the transporting direction and the sub-scanning direction.

The liquid discharging apparatus 10 includes a liquid circulation device 30. The liquid circulation device 30 is mounted on the carriage 22. The liquid circulation device 30 is a device that supplies the liquid to the liquid discharging head 21 via the supply flow path 19 and collects the liquid from the liquid discharging head 21 to the supply flow path 19.

The liquid circulation device 30 includes the supply flow path 19. The supply flow path 19 supplies the liquid from the liquid supply source 18, which is positioned upstream in the supply direction A of the liquid, to the liquid discharging head 21, which is positioned downstream thereof. That is, the supply flow path 19 is a flow path that makes the liquid supply source 18 and the liquid discharging head 21 communicate with each other so as to supply the liquid in the liquid supply source 18 to the liquid discharging head 21.

The liquid circulation device 30 includes a collection flow path 35. The collection flow path 35 collects the liquid from the liquid discharging head 21, which is positioned upstream in the collection direction B of the liquid, to the supply flow path 19, which is positioned downstream thereof. That is, the collection flow path 35 makes the liquid discharging head 21 and the supply flow path 19 communicate with each other so as to collect the liquid in the liquid discharging head 21 to the supply flow path 19. The collection flow path 35 includes a plurality of flow paths so as to correspond to the type of liquid discharged from the liquid discharging head 21. The collection flow path 35 of the present embodiment includes four flow paths. When there is only one type of liquid discharged from the liquid discharging head 21, the liquid discharging apparatus 10 may include one collection flow path 35.

The liquid circulation device 30 includes a storage portion 40. The storage portion 40 stores the liquid. In the present embodiment, the storage portion 40 constitutes a part of the supply flow path 19. The storage portion 40 stores the liquid from the liquid supply source 18 via the supply flow path 19. In the present embodiment, the storage portion 40 constitutes a part of the collection flow path 35. The storage portion 40 stores the liquid collected from the liquid discharging head 21 via the collection flow path 35. That is, the collection flow path 35 couples the liquid discharging head 21 and the supply flow path 19 to each other via the storage portion 40. The storage portion 40 includes a plurality of storage portions so as to correspond to the type of liquid discharged from the liquid discharging head 21. The storage portion 40 of the present embodiment includes four storage portions. When there is only one type of liquid discharged from the liquid discharging head 21, the liquid discharging apparatus 10 may include one storage portion 40.

As described above, a part of the supply flow path 19 and the collection flow path 35 configures a circulation flow path 36 for circulating the liquid. The circulation flow path 36 includes a plurality of flow paths so as to correspond to the type of liquid discharged from the liquid discharging head 21. The circulation flow path 36 of the present embodiment includes four flow paths. When there is only one type of liquid discharged from the liquid discharging head 21, the liquid discharging apparatus 10 may include one circulation flow path 36.

The liquid circulation device 30 includes a pressurization pump 51, which is an example of a pressurization portion. The pressurization pump 51 makes the liquid flow in the supply direction A from the storage portion 40 toward the liquid discharging head 21 along the supply flow path 19. The pressurization pump 51 is shared with the type of liquid discharged from the liquid discharging head 21. The pressurization pump 51 of the present embodiment includes one pump.

The liquid circulation device 30 includes a depressurization pump 52, which is an example of a depressurization portion. The depressurization pump 52 makes the liquid flow in the collection direction B from the liquid discharging head 21 toward the storage portion 40 along the collection flow path 35. The depressurization pump 52 is shared with the type of liquid discharged from the liquid discharging head 21. The depressurization pump 52 of the present embodiment includes one pump.

The liquid circulation device 30 includes a pressure adjustment device 60. The pressure adjustment device 60 is mounted on the carriage 22. In particular, in the present embodiment, the pressure adjustment device 60 is provided above the liquid discharging head 21. In other words, the pressure adjustment device 60 is provided at a position along a direction orthogonal to the width direction X and overlapping the plane that passes through the liquid discharging head 21. The pressure adjustment device 60 is coupled to the upstream of the liquid discharging head 21 in the supply flow path 19 and adjusts the pressure of the liquid supplied to the liquid discharging head 21. The pressure adjustment device 60 is coupled to the downstream of the liquid discharging head 21 in the collection flow path 35 and adjusts the pressure of the liquid collected from the liquid discharging head 21. The pressure adjustment device 60 includes a plurality of storage portions so as to correspond to the type of liquid discharged from the liquid discharging head 21. The pressure adjustment device 60 of the present embodiment includes four pressure adjustment devices. When there is only one type of liquid discharged from the liquid discharging head 21, the liquid discharging apparatus 10 may include one pressure adjustment device 60.

In the present embodiment, a filter unit (not illustrated) is provided in the supply flow path 19. The filter unit captures air bubbles or foreign substances in the liquid.

Figure 3:
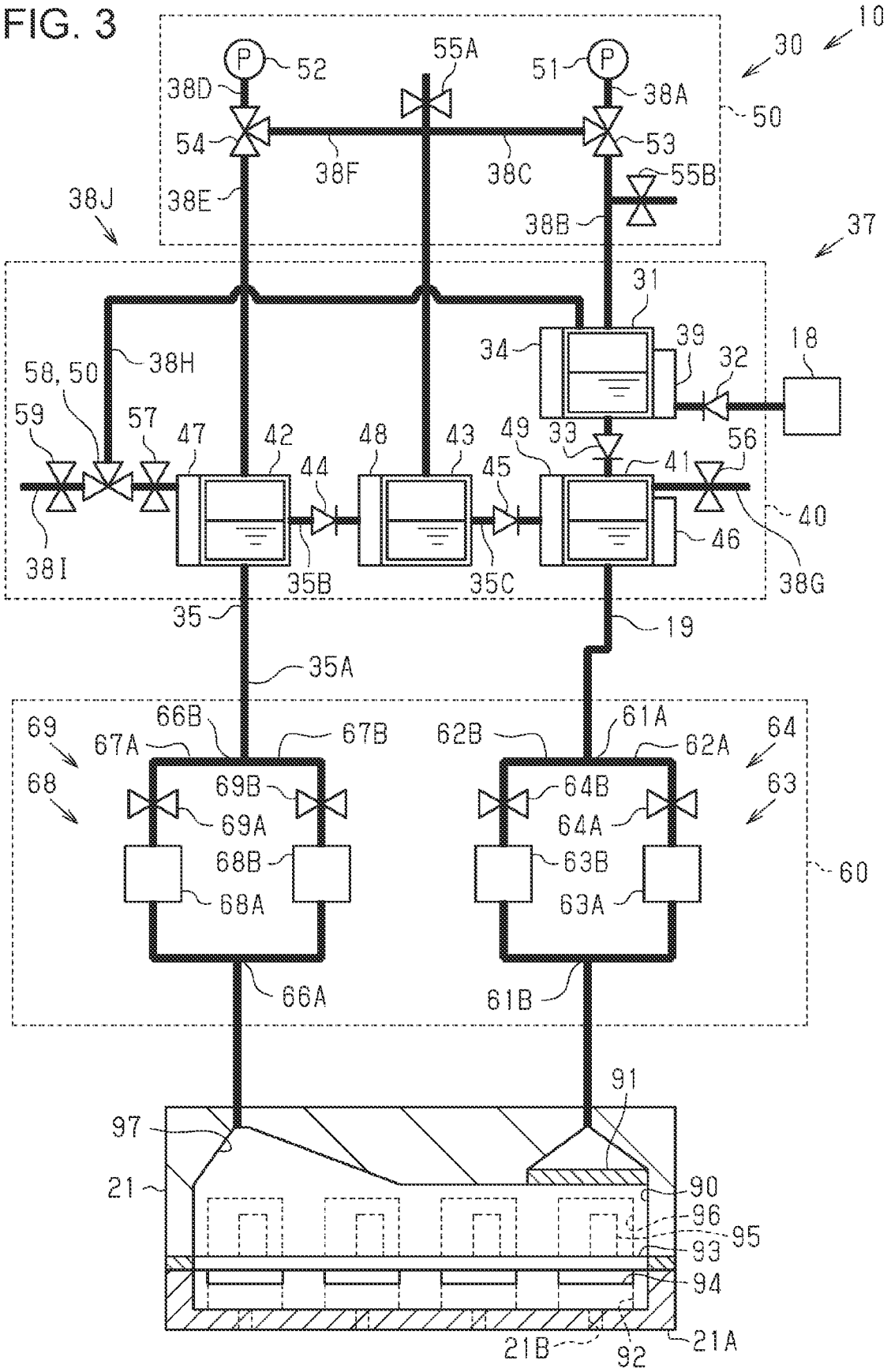
FIG. 3 is a schematic view illustrating an internal configuration of the liquid discharging apparatus.

Next, the liquid discharging head 21 and the liquid circulation device 30 in the liquid discharging apparatus 10 will be described with reference to FIG. 3. In FIG. 3, only the configuration of one system, among the configurations of a plurality of systems, corresponding to the type of liquid discharged from the liquid discharging head 21 is described as a representative.

As illustrated in FIG. 3, the liquid discharging head 21 includes a common liquid chamber 90 to which the liquid is supplied. The liquid is supplied to the common liquid chamber 90 from the liquid supply source 18 via the supply flow path 19. The supply flow path 19 is coupled to the common liquid chamber 90. The common liquid chamber 90 may be provided with a filter 91 that captures air bubbles, foreign substances, or the like in the supplied liquid. The common liquid chamber 90 stores the liquid that passes through the filter 91.

The liquid discharging head 21 includes a plurality of pressure chambers 92 communicating with the common liquid chamber 90. The nozzles 21B are provided corresponding to the plurality of pressure chambers 92. The pressure chamber 92 communicates with the common liquid chamber 90 and the nozzle 21B. A part of a wall surface of the pressure chamber 92 is formed by a vibrating plate 93. The common liquid chamber 90 and the pressure chamber 92 communicate with each other via a supply side communication path 94.

The liquid discharging head 21 includes a plurality of actuators 95 provided corresponding to the plurality of pressure chambers 92. The actuator 95 is provided on a surface of the vibrating plate 93 opposite to a part facing the pressure chamber 92. The actuator 95 is accommodated in an accommodation chamber 96 disposed at a position different from that of the common liquid chamber 90. The liquid discharging head 21 discharges the liquid in the pressure chamber 92 as droplets from the nozzle 21B by driving the actuator 95. The liquid discharging head 21 executes a printing process on the medium M by discharging the liquid from the nozzle 21B with respect to the medium M.

The actuator 95 of the present embodiment is constituted by a piezoelectric element that contracts when a drive voltage is applied. When the application of the drive voltage to the actuator 95 is released after the vibrating plate 93 is deformed in accordance with the contraction of the actuator 95 due to the application of the drive voltage, the liquid in the pressure chamber 92, whose volume is changed, is discharged as droplets from the nozzle 21B.

The liquid discharging head 21 includes an exhaust flow path 97. The exhaust flow path 97 is coupled to the common liquid chamber 90 and the collection flow path 35 such that the liquid inside the common liquid chamber 90 is exhausted to the outside without passing through the pressure chamber 92. As described above, the exhaust flow path 97 can exhaust the liquid, which is in the liquid discharging head 21, to the collection flow path 35 without passing through the pressure chamber 92 that communicates with the nozzle 21B. The exhaust flow path 97 may be configured to exhaust the liquid to the outside via the pressure chamber 92.

The storage portion 40 includes a replenishment storage portion 31, a suction valve 32, and a discharge valve 33. The replenishment storage portion 31, the suction valve 32, and the discharge valve 33 are positioned in the supply flow path 19. The replenishment storage portion 31 is configured to be capable of storing the liquid supplied from the liquid supply source 18. The liquid stored in the replenishment storage portion 31 is supplied to the liquid discharging head 21 via a first storage portion 41 described later. That is, the replenishment storage portion 31 stores the liquid for replenishment in the first storage portion 41. The suction valve 32 is positioned more upstream than the replenishment storage portion 31 in the supply direction A in the supply flow path 19. The discharge valve 33 is positioned more downstream than the replenishment storage portion 31 in the supply direction A in the supply flow path 19. The suction valve 32 is configured so as to allow the flow of the liquid from upstream to downstream in the supply flow path 19 and regulate the flow of the liquid from downstream to upstream. The discharge valve 33 is configured so as to allow the flow of the liquid from upstream to downstream in the supply flow path 19 and regulate the flow of the liquid from downstream to upstream.

The storage portion 40 includes a first storage portion 41, a second storage portion 42, and a third storage portion 43. The first storage portion 41 is provided in the supply flow path 19. The first storage portion 41 is positioned more downstream than the discharge valve 33 in the supply direction A and is coupled to the replenishment storage portion 31 via the discharge valve 33 in the supply flow path 19. The liquid stored in the replenishment storage portion 31 is supplied to the first storage portion 41 via the discharge valve 33. As described above, the first storage portion 41 is configured to be capable of storing the liquid supplied from the liquid supply source 18. The supply flow path 19 makes the first storage portion 41 and the liquid discharging head 21 communicate with each other. Therefore, the first storage portion 41 is configured to be capable of storing the liquid supplied to the liquid discharging head 21 via the supply flow path 19.

The collection flow path 35 includes a first collection flow path 35A, a second collection flow path 35B, and a third collection flow path 35C. The first collection flow path 35A is a flow path coupled to the second storage portion 42 from the liquid discharging head 21 side. The second collection flow path 35B is a flow path coupled to the second storage portion 42 and the third storage portion 43. The third collection flow path 35C is a flow path coupled to the third storage portion 43 and the first storage portion 41. That is, the first collection flow path 35A makes the liquid discharging head 21 and the second storage portion 42 communicate with each other. The second collection flow path 35B makes the second storage portion 42 and the third storage portion 43 communicate with each other. The third collection flow path 35C makes the third storage portion 43 and the first storage portion 41 communicate with each other.

The second storage portion 42 is provided in the collection flow path 35. The second storage portion 42 is capable of storing the liquid collected from the liquid discharging head 21 via the first collection flow path 35A.

The third storage portion 43 is provided in the collection flow path 35. The third storage portion 43 is capable of storing the liquid collected from the liquid discharging head 21 via the second collection flow path 35B. That is, the third storage portion 43 is configured to be capable of storing the liquid collected from the liquid discharging head 21 between the second storage portion 42 and the first storage portion 41.

The first storage portion 41 is capable of storing the liquid collected from the liquid discharging head 21 via the third collection flow path 35C. As described above, in the present embodiment, the first storage portion 41 corresponds to an example of a connection portion of the supply flow path 19 in which the collection flow path 35 is coupled to the supply flow path 19.

The storage portion 40 includes a first check valve 44 and a second check valve 45. The first check valve 44 is provided in the second collection flow path 35B. The first check valve 44 is configured so as to allow the flow of the liquid from upstream to downstream in the collection flow path 35 and regulate the flow of the liquid from downstream to upstream. The second check valve 45 is provided in the third collection flow path 35C. The second check valve 45 is configured so as to allow the flow of the liquid from upstream to downstream in the collection flow path 35 and regulate the flow of the liquid from downstream to upstream. That is, the first check valve 44 allows the flow of liquid from the second storage portion 42 to the third storage portion 43 in the second collection flow path 35B while regulating the flow of the liquid from the third storage portion 43 to the second storage portion 42. The second check valve 45 allows the flow of liquid from the third storage portion 43 to the first storage portion 41 in the third collection flow path 35C while regulating the flow of the liquid from the first storage portion 41 to the third storage portion 43.

The storage portion 40 includes a first storage amount detection portion 46. The first storage amount detection portion 46 is capable of detecting the storage amount in which the liquid is stored in the first storage portion 41. In the present embodiment, the first storage amount detection portion 46 is capable of at least detecting that the storage amount of the liquid, which is stored in the first storage portion 41, is equal to or less than a first defined amount and the storage amount of the liquid, which is stored in the first storage portion 41, is equal to or less than a second defined amount. The first defined amount is a reference amount that is required for the first storage portion 41 to be replenished with the liquid. The second defined amount is a reference amount for determining whether the first storage portion 41 is replenished with the sufficient liquid stored thereof. The second defined amount is larger than the first defined amount.

The storage portion 40 includes a replenishment storage amount detection portion 39. The replenishment storage amount detection portion 39 is capable of detecting the storage amount of the liquid stored in the replenishment storage portion 31. In the present embodiment, the replenishment storage amount detection portion 39 is capable of at least detecting that the storage amount of the liquid, which is stored in the replenishment storage portion 31, is equal to or less than a third defined amount. The third defined amount is a reference amount that is an upper limit that the liquid can be supplied to the replenishment storage portion 31.

In a case where the liquid is supplied from the first storage portion 41 to the liquid discharging head 21, when the storage amount of the liquid, which is stored in the first storage portion 41, is equal to the first defined amount, the first storage portion 41 is replenished with the liquid from the third storage portion 43 over a second time, which will be described in detail later.

In the present embodiment, when the storage amount of the liquid, which is stored in at least one of the first storage portions 41, among the plurality of first storage portions 41 is equal to the first defined amount, the plurality of first storage portions 41 are respectively replenished with the liquid from the plurality of third storage portions 43.

As a result of replenishing the first storage portion 41 with the liquid from the third storage portion 43 over the second time, when the storage amount of the liquid, which is stored in the first storage portion 41, is not less than the second defined amount, the replenishment storage portion 31 is not replenished with the liquid from the liquid supply source 18. On the other hand, as a result of replenishing the first storage portion 41 with the liquid from the third storage portion 43 over the second time, when the storage amount of the liquid, which is stored in the first storage portion 41, is less than the second defined amount, the liquid is supplied from the liquid supply source 18 to the replenishment storage portion 31 communicating with the first storage portion 41 in which the amount thereof is less than the second defined amount.

In a case where the liquid is supplied from the liquid supply source 18 to the replenishment storage portion 31 when the storage amount of the liquid, which is stored in the replenishment storage portion 31, is equal to the third defined amount, the supply of the liquid from the liquid supply source 18 to the replenishment storage portion 31 is ended.

The storage portion 40 includes a first temperature adjustment portion 47, a second temperature adjustment portion 48, a third temperature adjustment portion 49, and a replenishment temperature adjustment portion 34. The first temperature adjustment portion 47 is provided in the first storage portion 41. The first temperature adjustment portion 47 adjusts the temperature so as to heat the liquid stored in the first storage portion 41. The second temperature adjustment portion 48 is provided in the second storage portion 42. The second temperature adjustment portion 48 adjusts the temperature so as to heat the liquid stored in the second storage portion 42. The third temperature adjustment portion 49 is provided in the third storage portion 43. The third temperature adjustment portion 49 adjusts the temperature so as to heat the liquid stored in the third storage portion 43. The replenishment temperature adjustment portion 34 is provided in the replenishment storage portion 31. The replenishment temperature adjustment portion 34 adjusts the temperature so as to heat the liquid stored in the replenishment storage portion 31. In the present embodiment, each temperature adjustment portions 34, 47 to 49 is configured to transmit the heat, which is generated by a heater, to the liquid in each storage portion via a metal plate, for example, by operating the heater, but the present disclosure is not limited to this. The heater and the metal plate are provided on a wall surface of each storage portion and may be integrally configured with each storage portion, and the space can be saved. In the present embodiment, the first temperature adjustment portion 47, the second temperature adjustment portion 48, the third temperature adjustment portion 49, and the replenishment temperature adjustment portion 34 correspond to an example of a heating portion.

The storage portion 40 includes a second atmosphere communication path 38G and a pressurization opening portion 56. The second atmosphere communication path 38G is coupled to the first storage portion 41. That is, in the present embodiment, the second atmosphere communication path 38G is provided in the first storage portion 41. The second atmosphere communication path 38G communicates with the atmosphere.

The pressurization opening portion 56 is provided in the second atmosphere communication path 38G. The pressurization opening portion 56 is coupled to the first storage portion 41 via the second atmosphere communication path 38G. The pressurization opening portion 56 can switch whether or not to communicate with the atmosphere. When the positive pressure on the first storage portion 41 side is higher than a predetermined positive pressure via the second atmosphere communication path 38G, the pressurization opening portion 56 opens the second atmosphere communication path 38G and makes the first storage portion 41 communicate with the atmosphere. As described above, since the first storage portion 41 communicates with the atmosphere when the positive pressure is equal to the predetermined positive pressure, it is possible to prevent the first storage portion 41 from having an excessive pressurization that is significantly higher than the predetermined positive pressure. In the present embodiment, the predetermined positive pressure corresponds to, for example, 45 kPa, but the present disclosure is not limited to this.

The storage portion 40 includes a replenishment communication flow path 38H, a first atmosphere communication path 38I, a first negative pressure opening portion 57, and a second negative pressure opening portion 59. The replenishment communication flow path 38H is coupled to the second storage portion 42 and the replenishment storage portion 31. The replenishment communication flow path 38H is a flow path that makes the second storage portion 42 and the replenishment storage portion 31 communicate with each other.

The first negative pressure opening portion 57 is positioned on the second storage portion 42 side in the replenishment communication flow path 38H. When the negative pressure on the second storage portion 42 side is lower than a predetermined negative pressure via the replenishment communication flow path 38H, the first negative pressure opening portion 57 opens the replenishment communication flow path 38H. In the present embodiment, the predetermined negative pressure corresponds to, for example, −35 kPa, but the present disclosure is not limited to this.

The first atmosphere communication path 38I is coupled to the replenishment communication flow path 38H via a replenishment switching portion 58 described later. The first atmosphere communication path 38I communicates with the atmosphere in the replenishment communication flow path 38H.

When the negative pressure on the replenishment communication flow path 38H side is lower than the predetermined negative pressure via the replenishment communication flow path 38H, the second negative pressure opening portion 59 opens the first atmosphere communication path 38I. In the present embodiment, the predetermined negative pressure corresponds to, for example, −35 kPa, but the present disclosure is not limited to this.

In the present embodiment, a flow path 38E and the replenishment communication flow path 38H, which couple the depressurization switching portion 54 and the replenishment storage portion 31 to each other via the second storage portion 42, are referred to as a second communication flow path 38J. The second communication flow path 38J is constituted by the flow path 38E and the replenishment communication flow path 38H and can be said to include the replenishment communication flow path 38H.

The liquid circulation device 30 includes a circulation device 50. The circulation device 50 includes the pressurization pump 51, the depressurization pump 52, a pressurization switching portion 53, a depressurization switching portion 54, a first atmosphere opening portion 55A, a second atmosphere opening portion 55B, and the replenishment switching portion 58.

The pressurization switching portion 53 is coupled to the pressurization pump 51 via a flow path 38A. The pressurization switching portion 53 is configured to be capable of being coupled to the replenishment storage portion 31 via the first communication flow path 38B. That is, the first communication flow path 38B makes the pressurization switching portion 53 and the replenishment storage portion 31 communicate with each other. The pressurization switching portion 53 is configured to be capable of being coupled to the third storage portion 43 via a flow path 38C. The pressurization switching portion 53 can switch between coupling the pressurization pump 51 and the replenishment storage portion 31 or coupling the pressurization pump 51 and the third storage portion 43 according to an instruction of a control portion 100 described later. That is, the pressurization switching portion 53 can switch a target to be pressurized by the pressurization pump 51 according to the instruction of the control portion 100. Further, the pressurization pump 51 is configured to be capable of pressurizing the third storage portion 43 and the replenishment storage portion 31. The pressurization switching portion 53 is shared with the type of liquid discharged from the liquid discharging head 21. The pressurization switching portion 53 of the present embodiment includes one switching portion.

The depressurization switching portion 54 is coupled to the depressurization pump 52 via a flow path 38D. The depressurization switching portion 54 is configured to be capable of being coupled to the second storage portion 42 via the flow path 38E. The depressurization switching portion 54 is configured to be capable of being coupled to the third storage portion 43 via a flow path 38F. The depressurization switching portion 54 can switch between coupling the depressurization pump 52 and the second storage portion 42 or coupling the depressurization pump 52 and the second storage portion 42 according to the instruction of the control portion 100. That is, the depressurization switching portion 54 can switch a target to be depressurized by the depressurization pump 52 according to the instruction of the control portion 100. Further, the depressurization pump 52 is configured to be capable of depressurizing the second storage portion 42 and the third storage portion 43. The depressurization switching portion 54 is shared with the type of liquid discharged from the liquid discharging head 21. The depressurization switching portion 54 of the present embodiment includes one switching portion. In the present embodiment, the flow path 38C and the flow path 38F are flow paths that are merged on the third storage portion 43 side, but the present disclosure is not limited to this.

The first atmosphere opening portion 55A is coupled to the flow path 38C and the flow path 38F. The first atmosphere opening portion 55A can switch whether or not to make the flow path 38C and the flow path 38F communicate with the atmosphere according to the instruction of the control portion 100. That is, the first atmosphere opening portion 55A is configured to be capable of opening the flow paths 38C and 38F, which make the third storage portion 43, and the pressurization switching portion 53 and the depressurization switching portion 54 communicate with each other, to the atmosphere. In other words, the first atmosphere opening portion 55A is coupled to the third storage portion 43 and can switch whether or not to make the third storage portion 43 communicate with the atmosphere according to the instruction of the control portion 100. The first atmosphere opening portion 55A is shared with the type of liquid discharged from the liquid discharging head 21. The first atmosphere opening portion 55A of the present embodiment includes one opening portion.

The second atmosphere opening portion 55B is coupled to the first communication flow path 38B. The second atmosphere opening portion 55B can switch whether or not to make the first communication flow path 38B communicate with the atmosphere according to the instruction of the control portion 100. That is, the second atmosphere opening portion 55B is configured to be capable of opening the first communication flow path 38B to the atmosphere. In other words, the second atmosphere opening portion 55B is coupled to the replenishment storage portion 31 and can switch whether or not to make the replenishment storage portion 31 communicate with the atmosphere according to the instruction of the control portion 100.

In the present embodiment, the flow path 38A is constituted by one flow path and is shared with the type of liquid discharged from the liquid discharging head 21. The first communication flow path 38B branches from one flow path to a plurality of flow paths provided on the replenishment storage portion 31 side from the second atmosphere opening portion 55B, and the plurality of branched flow paths are coupled to a plurality of replenishment storage portions 31, respectively. The flow path 38C branches from one flow path to a plurality of flow paths provided on the third storage portion 43 side from the first atmosphere opening portion 55A, and the plurality of branched flow paths are coupled to a plurality of third storage portions 43, respectively. The flow path 38D is constituted by one flow path and is shared with the type of liquid discharged from the liquid discharging head 21. The flow path 38E branches from one flow path to a plurality of flow paths, and the plurality of branched flow paths are coupled to a plurality of second storage portions 42, respectively. The flow path 38F branches from one flow path to a plurality of flow paths provided on the third storage portion 43 side from the first atmosphere opening portion 55A, and the plurality of branched flow paths are coupled to a plurality of third storage portions 43, respectively.

The replenishment switching portion 58 is provided in the replenishment communication flow path 38H. The replenishment switching portion 58 is positioned between the first negative pressure opening portion 57 and the replenishment storage portion 31 in the replenishment communication flow path 38H. The replenishment switching portion 58 is configured to be capable of being coupled to the first atmosphere communication path 38I. The replenishment switching portion 58 can switch whether or not to make the second storage portion 42 and the replenishment storage portion 31 communicate with each other according to the instruction of the control portion 100. That is, the replenishment switching portion 58 is configured to be capable of switching between a first communication state in which the second storage portion 42 and the replenishment storage portion 31 communicate with each other, and a second communication state in which the second storage portion 42 and the first atmosphere communication path 38I communicate with each other. As described above, the replenishment switching portion 58 can switch whether or not to depressurize the replenishment storage portion 31 according to the instruction of the control portion 100. In the present embodiment, a plurality of replenishment switching portions 58 are provided so as to correspond to the type of liquid discharged from the liquid discharging head 21. The replenishment switching portion 58 of the present embodiment includes four replenishment switching portions 58. When there is only one type of liquid discharged from the liquid discharging head 21, the liquid discharging apparatus 10 may include one replenishment switching portion 58.

In the present embodiment, when the second storage portion 42 is depressurized by the depressurization pump 52, the first negative pressure opening portion 57 opens the replenishment communication flow path 38H when the negative pressure on the second storage portion 42 side is lower than the predetermined negative pressure. In this case, when the replenishment switching portion 58 is controlled to be the first communication state, the first negative pressure opening portion 57 and the replenishment storage portion 31 communicate with each other. Therefore, the replenishment storage portion 31 is depressurized by the depressurization pump 52, and the liquid in the liquid supply source 18 is supplied to the replenishment storage portion 31. On the other hand, when the replenishment switching portion 58 is controlled to be the second communication state, the first negative pressure opening portion 57 and the second negative pressure opening portion 59 communicate with each other. Therefore, the replenishment storage portion 31 is not depressurized by the depressurization pump 52, and the liquid in the liquid supply source 18 is not supplied to the replenishment storage portion 31. Further, the second negative pressure opening portion 59 opens the first atmosphere communication path 38I when the negative pressure on the replenishment communication flow path 38H side is lower than the predetermined negative pressure. As a result, the atmosphere is released to the second storage portion 42, and it is possible to prevent the second storage portion 42 from having an excessive negative pressure that is significantly lower than the predetermined negative pressure.

In the present embodiment, a control state, in which the pressurization switching portion 53 is controlled according to the instruction of the control portion 100, includes a first pressurization state and a second pressurization state. In the present embodiment, the control state, in which the depressurization switching portion 54 is controlled according to the instruction of the control portion 100, includes a first depressurization state and a second depressurization state. In the present embodiment, the control state, in which the replenishment switching portion 58 is controlled according to the instruction of the control portion 100, includes a first communication state and a second communication state.

Figure 4:
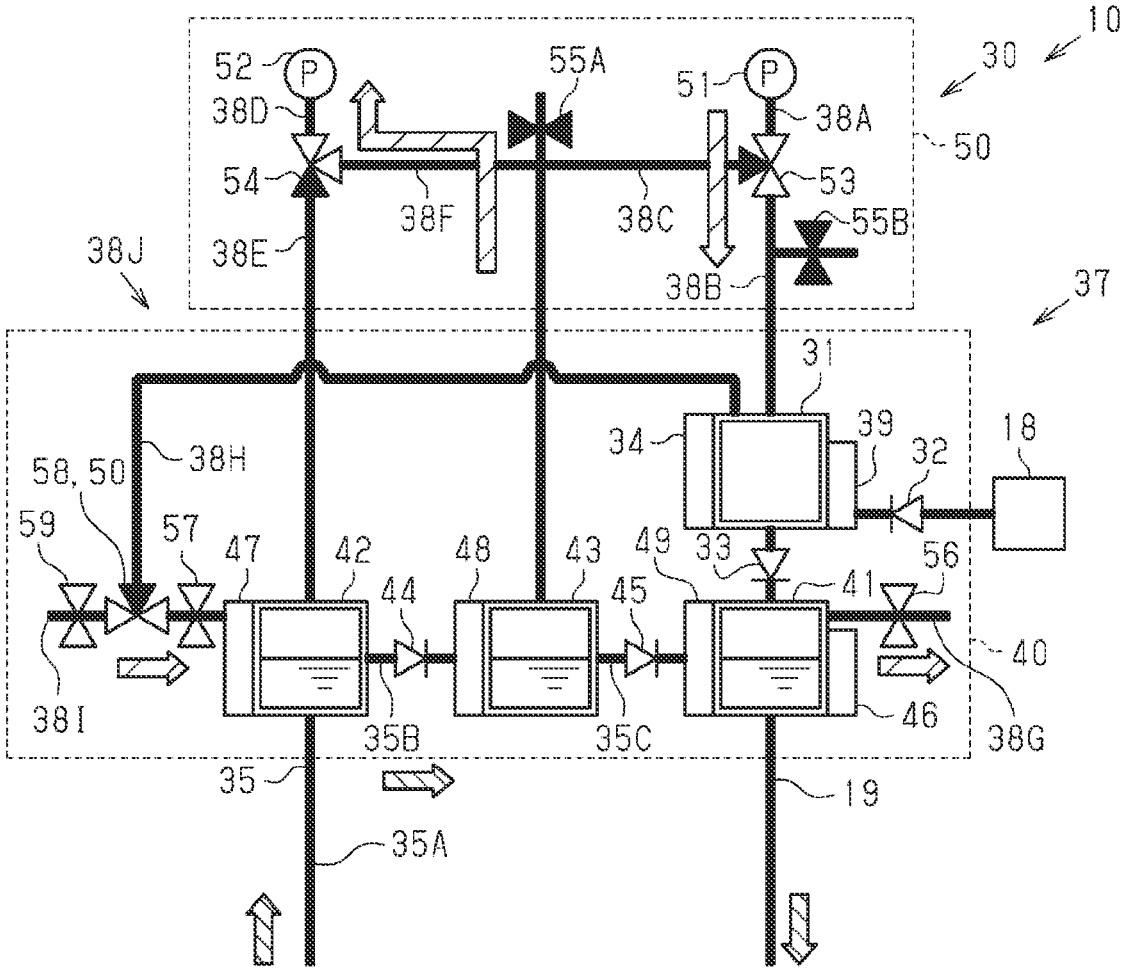
FIG. 4 is a schematic view illustrating an internal configuration of the liquid discharging apparatus.

As illustrated in FIG. 4, the first pressurization state is a state in which the pressurization pump 51 and the replenishment storage portion 31 communicate with each other, and the replenishment storage portion 31 is pressurized by the pressurization pump 51. The first storage portion 41 communicates with the pressurization pump 51 via the replenishment storage portion 31. Therefore, the first pressurization state is a state in which the pressurization pump 51 and the first storage portion 41 communicate with each other via the replenishment storage portion 31, and is a state in which the first storage portion 41 is pressurized by the pressurization pump 51 via the replenishment storage portion 31. When the liquid is not stored in the replenishment storage portion 31, the first storage portion 41 is not replenished with the liquid from the replenishment storage portion 31.

When the first storage portion 41 is pressurized by the pressurization pump 51, the flow of the liquid stored in the first storage portion 41 to the third collection flow path 35C is regulated by the second check valve 45. Therefore, the liquid stored in the first storage portion 41 flows to the liquid discharging head 21 side along the supply direction A in the supply flow path 19.

The second depressurization state is a state in which the depressurization pump 52 and the third storage portion 43 communicate with each other, and the third storage portion 43 is depressurized by the depressurization pump 52. When the third storage portion 43 is depressurized by the depressurization pump 52, the flow of the liquid stored in the first storage portion 41 to the third collection flow path 35C is regulated by the second check valve 45. Therefore, the liquid stored in the second storage portion 42 flows to the third storage portion 43 along the collection direction B via the second collection flow path 35B.

The second communication state is a state in which the second storage portion 42 and the second negative pressure opening portion 59 are capable of communicating with each other via the replenishment communication flow path 38H and the first atmosphere communication path 38I. The second communication state is a state in which the second storage portion 42 and the replenishment storage portion 31 do not communicate with each other via the replenishment communication flow path 38H. As described above, the second communication state is a state in which the replenishment storage portion 31 that does not communicate with the second storage portion 42 is not depressurized even when the second storage portion 42 is depressurized by the depressurization pump 52.

Figure 5:
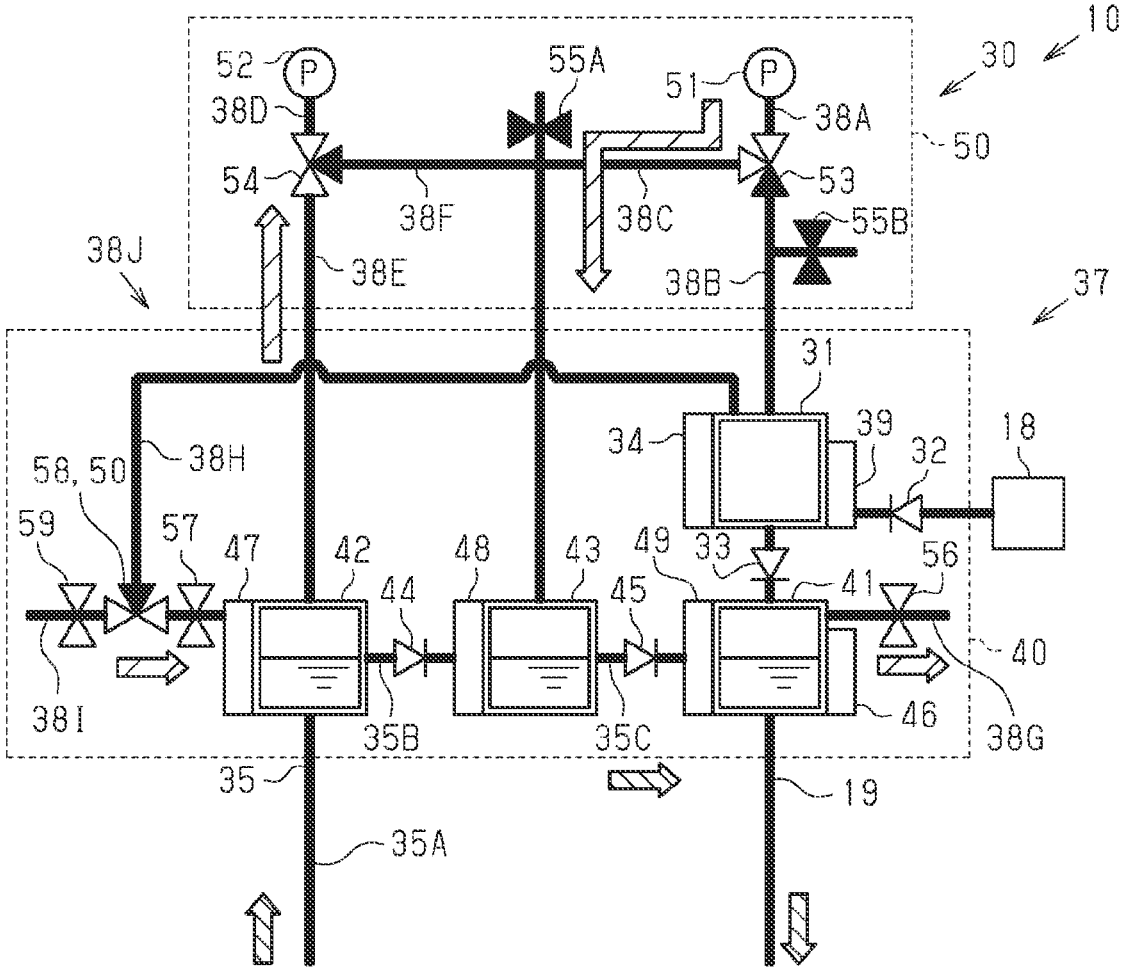
FIG. 5 is a schematic view illustrating an internal configuration of the liquid discharging apparatus.

On the other hand, as illustrated in FIG. 5, the first depressurization state is a state in which the depressurization pump 52 and the second storage portion 42 communicate with each other, and the second storage portion 42 is depressurized by the depressurization pump 52. When the second storage portion 42 is depressurized by the depressurization pump 52, the flow of the liquid stored in the third storage portion 43 to the second collection flow path 35B is regulated by the first check valve 44. Therefore, the liquid from the liquid discharging head 21 flows to the second storage portion 42 along the collection direction B via the first collection flow path 35A.

The second pressurization state is a state in which the pressurization pump 51 and the third storage portion 43 communicate with each other, and the third storage portion 43 is pressurized by the pressurization pump 51. When the third storage portion 43 is pressurized by the pressurization pump 51, the flow of the liquid stored in the third storage portion 43 to the second collection flow path 35B is regulated by the first check valve 44. Therefore, the liquid stored in the third storage portion 43 flows to the first storage portion 41 along the collection direction B in the third collection flow path 35C.

Figure 6:
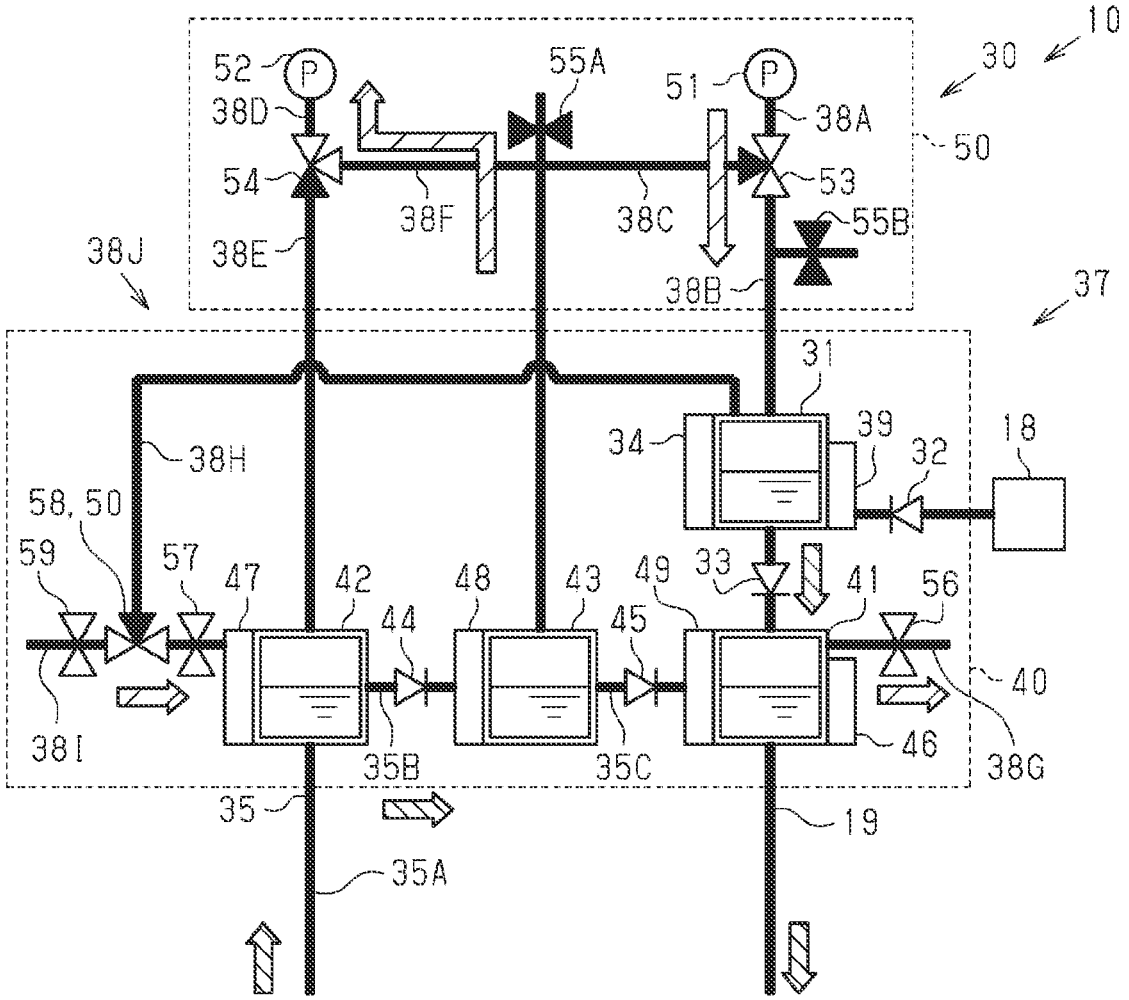
FIG. 6 is a schematic view illustrating an internal configuration of the liquid discharging apparatus.

Further, as illustrated in FIG. 6, the first pressurization state is a state in which the replenishment storage portion 31 is pressurized by the pressurization pump 51. In a case where the liquid is stored in the replenishment storage portion 31, when the replenishment storage portion 31 is controlled to be the first pressurization state, the first storage portion 41 is replenished with the liquid from the replenishment storage portion 31. In this case, the first storage portion 41 is pressurized by the pressurization pump 51 via the replenishment storage portion 31 and the supply flow path 19.

Figure 7:
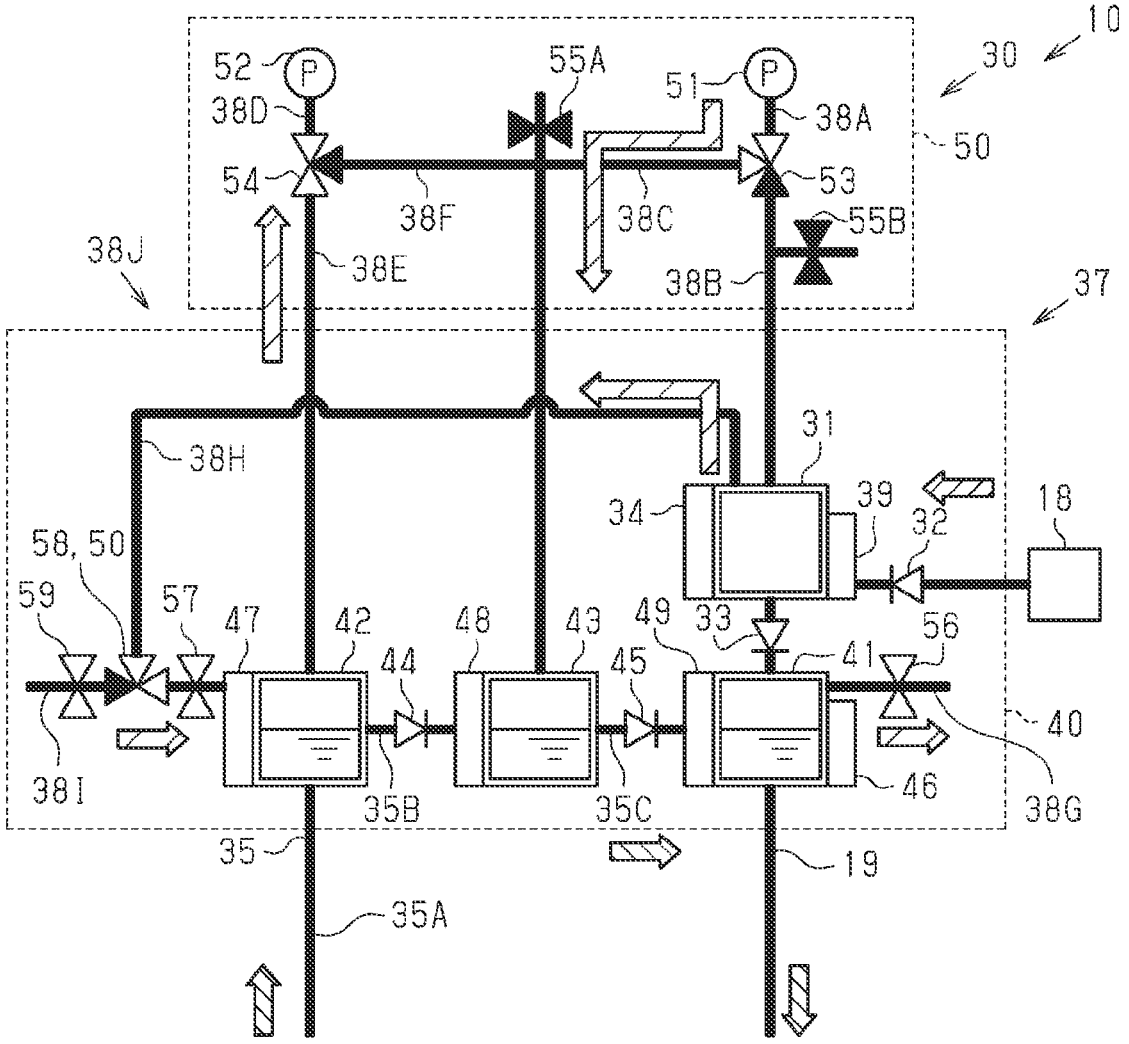
FIG. 7 is a schematic view illustrating an internal configuration of the liquid discharging apparatus.

On the other hand, as illustrated in FIG. 7, the first communication state is a state in which the second storage portion 42 and the replenishment storage portion 31 are capable of communicating with each other via the replenishment communication flow path 38H. The first communication state is a state in which the second storage portion 42 and the second negative pressure opening portion 59 do not communicate with each other via the replenishment communication flow path 38H and the first atmosphere communication path 38I. As described above, the first communication state is a state in which the replenishment storage portion 31 is depressurized via the second storage portion 42 when the second storage portion 42 is depressurized by the depressurization pump 52.

When the replenishment storage portion 31 is depressurized by the depressurization pump 52, the flow of the liquid stored in the first storage portion 41 to the replenishment storage portion 31 is regulated by the discharge valve 33. Further, the liquid in the liquid supply source 18 flows to the replenishment storage portion 31 along the supply direction A via the supply flow path 19.

As illustrated in FIG. 3, the pressure adjustment device 60 includes a supply branch portion 61A, a first positive pressure supply flow path 62A, a second positive pressure supply flow path 62B, and a supply merging portion 61B, as the supply flow path 19. The supply branch portion 61A is provided on the first storage portion 41 side in the supply flow path 19. The supply branch portion 61A branches the supply flow path 19 into the first positive pressure supply flow path 62A and the second positive pressure supply flow path 62B. The supply merging portion 61B is provided on the liquid discharging head 21 side in the supply flow path 19. The supply merging portion 61B merges the first positive pressure supply flow path 62A and the second positive pressure supply flow path 62B. As described above, the supply branch portion 61A, the first positive pressure supply flow path 62A, the second positive pressure supply flow path 62B, and the supply merging portion 61B are provided between the first storage portion 41 and the liquid discharging head 21 in the supply flow path 19.

The pressure adjustment device 60 includes a positive pressure adjustment portion 63 and a positive pressure opening/closing valve 64. The positive pressure adjustment portion 63 includes a first positive pressure adjustment portion 63A and a second positive pressure adjustment portion 63B. The positive pressure opening/closing valve 64 includes a first positive pressure opening/closing valve 64A and a second positive pressure opening/closing valve 64B.

The first positive pressure opening/closing valve 64A is provided on the supply branch portion 61A side in the first positive pressure supply flow path 62A. The first positive pressure opening/closing valve 64A is an opening/closing valve configured to be capable of opening/closing the first positive pressure supply flow path 62A according to the instruction of the control portion 100.

The second positive pressure opening/closing valve 64B is provided on the supply branch portion 61A side in the second positive pressure supply flow path 62B. The second positive pressure opening/closing valve 64B is an opening/closing valve configured to be capable of opening/closing the second positive pressure supply flow path 62B according to the instruction of the control portion 100.

As described above, in the present embodiment, the positive pressure opening/closing valve 64 is configured to be capable of switching the flow paths through which the liquid flows in the first positive pressure supply flow path 62A and the second positive pressure supply flow path 62B in the supply flow path 19. In the present embodiment, the positive pressure opening/closing valve 64 includes the first positive pressure opening/closing valve 64A and the second positive pressure opening/closing valve 64B provided in each of the first positive pressure supply flow path 62A and the second positive pressure supply flow path 62B in the supply flow path 19.

In the first positive pressure supply flow path 62A, the first positive pressure adjustment portion 63A is provided more downstream than the first positive pressure opening/closing valve 64A in the supply direction A. The first positive pressure adjustment portion 63A is an opening/closing valve that opens the first positive pressure supply flow path 62A when the pressure on the liquid discharging head 21 side becomes a first positive pressure. In the present embodiment, the first positive pressure corresponds to, for example, 5.64 kPa, but the present disclosure is not limited to this.

In the second positive pressure supply flow path 62B, the second positive pressure adjustment portion 63B is provided more downstream than the second positive pressure opening/closing valve 64B in the supply direction A. The second positive pressure adjustment portion 63B is an opening/closing valve that opens the second positive pressure supply flow path 62B when the pressure on the liquid discharging head 21 side becomes a second positive pressure. In the present embodiment, the second positive pressure is higher than the first positive pressure, for example, 31.23 kPa is applicable, but the present disclosure is not limited to this.

As described above, in the present embodiment, the first positive pressure adjustment portion 63A and the second positive pressure adjustment portion 63B are a plurality of positive pressure adjustment portions 63 that open the flow path when the pressure on the liquid discharging head 21 side is lower than the predetermined positive pressure. In the present embodiment, the first positive pressure adjustment portion 63A and the second positive pressure adjustment portion 63B have different predetermined positive pressures for opening the flow paths in each of the first positive pressure supply flow path 62A and the second positive pressure supply flow path 62B.

The pressure adjustment device 60 includes a collection branch portion 66A, a first negative pressure collection flow path 67A, a second negative pressure collection flow path 67B, and a collection merging portion 66B, as the collection flow path 35. The collection branch portion 66A is provided on the liquid discharging head 21 side in the collection flow path 35. The collection branch portion 66A branches the collection flow path 35 into the first positive pressure supply flow path 62A and the second positive pressure supply flow path 62B. The collection merging portion 66B is provided on the second storage portion 42 side in the collection flow path 35. The collection merging portion 66B merges the first negative pressure collection flow path 67A and the second negative pressure collection flow path 67B. As described above, the collection branch portion 66A, the first negative pressure collection flow path 67A, the second negative pressure collection flow path 67B, and the collection merging portion 66B are provided between the liquid discharging head 21 and the first storage portion 41 in the collection flow path 35.

The pressure adjustment device 60 includes a negative pressure adjustment portion 68 and a negative pressure opening/closing valve 69. The negative pressure adjustment portion 68 includes a first negative pressure adjustment portion 68A and a second negative pressure adjustment portion 68B. The negative pressure opening/closing valve 69 includes a first negative pressure opening/closing valve 69A and a second negative pressure opening/closing valve 69B.

The first negative pressure opening/closing valve 69A is provided on the collection branch portion 66A side in the first negative pressure collection flow path 67A. The first negative pressure opening/closing valve 69A is an opening/closing valve configured to be capable of opening/closing the first negative pressure collection flow path 67A according to the instruction of the control portion 100.

The second negative pressure opening/closing valve 69B is provided on the collection branch portion 66A side in the second negative pressure collection flow path 67B. The second negative pressure opening/closing valve 69B is an opening/closing valve configured to be capable of opening/closing the second negative pressure collection flow path 67B according to the instruction of the control portion 100.

As described above, in the present embodiment, the negative pressure opening/closing valve 69 is configured to be capable of switching the flow paths through which the liquid flows in the first negative pressure collection flow path 67A and the second negative pressure collection flow path 67B in the collection flow path 35. In the present embodiment, the negative pressure opening/closing valve 69 includes the first negative pressure opening/closing valve 69A and the second negative pressure opening/closing valve 69B provided in each of the first negative pressure collection flow path 67A and the second negative pressure collection flow path 67B in the collection flow path 35.

In the first negative pressure collection flow path 67A, the first negative pressure adjustment portion 68A is provided more upstream than the first negative pressure opening/closing valve 69A in the collection direction B. The first negative pressure adjustment portion 68A is an opening/closing valve that opens the first negative pressure collection flow path 67A when the pressure on the liquid discharging head 21 side becomes a first negative pressure. In the present embodiment, the first negative pressure corresponds to, for example, −2.76 kPa, but the present disclosure is not limited to this.

In the second negative pressure collection flow path 67B, the second negative pressure adjustment portion 68B is provided more upstream than the second negative pressure opening/closing valve 69B in the collection direction B. The second negative pressure adjustment portion 68B is an opening/closing valve that opens the second negative pressure collection flow path 67B when the pressure on the liquid discharging head 21 side becomes a second negative pressure. In the present embodiment, the second negative pressure is lower than the first positive pressure, for example, −8.27 kPa is applicable, but the present disclosure is not limited to this.

In the present embodiment, the supply flow path 19, the storage portion 40, the pressure adjustment device 60, the collection flow path 35, and various flow paths 38G to 38I function as the liquid circulation mechanism 37. The liquid circulation device 30 includes a plurality of liquid circulation mechanisms 37. The plurality of liquid circulation mechanisms 37 are configured to be capable of being pressurized by the shared pressurization pump 51 and are configured to be capable of being depressurized by the shared depressurization pump 52.

In the present embodiment, at least any one of the supply branch portion 61A and the collection branch portion 66A corresponds to an example of the branch portion. In the present embodiment, at least any one of the first positive pressure supply flow path 62A and the second positive pressure supply flow path 62B as the supply flow path 19, and the first negative pressure collection flow path 67A and second negative pressure collection flow path 67B as the collection flow path 35, corresponds to an example of a plurality of flow paths. In the present embodiment, at least any one of the supply merging portion 61B and the collection merging portion 66B corresponds to an example of the merging portion.

In the present embodiment, the positive pressure opening/closing valve 64 and the negative pressure opening/closing valve 69 correspond to an example of the flow path switching portion. In the present embodiment, the positive pressure opening/closing valve 64 corresponds to an example of the first flow path switching portion. That is, the flow path switching portion includes the first flow path switching portion. In the present embodiment, the negative pressure opening/closing valve 69 corresponds to an example of the second flow path switching portion. That is, the flow path switching portion includes the second flow path switching portion.

Next, each pressure adjustment portion of the pressure adjustment device 60 will be described with reference to FIGS. 8 and 9. The first positive pressure adjustment portion 63A and the first negative pressure adjustment portion 68A will be described as representatives.

Figure 8:
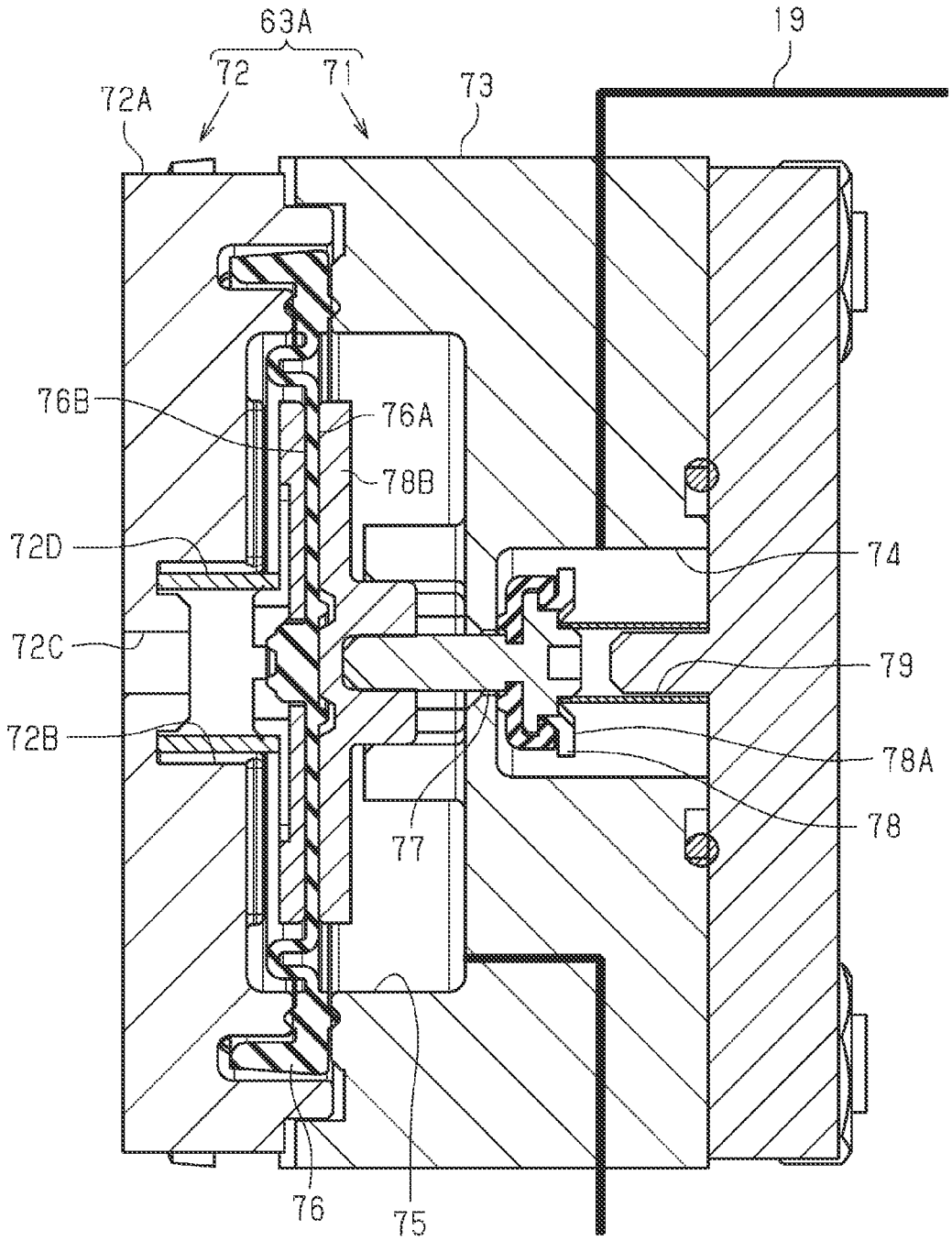
FIG. 8 is a schematic view illustrating an internal configuration of a pressure adjustment portion.

As illustrated in FIG. 8, the first positive pressure adjustment portion 63A includes a pressure adjustment mechanism 71. The pressure adjustment mechanism 71 constitutes a part of the supply flow path 19. The pressure adjustment mechanism 71 includes a main body portion 73. A liquid inflow portion 74 and a liquid outflow portion 75 are formed in the main body portion 73. The liquid, which is supplied from the liquid supply source 18 via the supply flow path 19, flows into the liquid inflow portion 74. The liquid outflow portion 75 is configured to be capable of accommodating the liquid inside. In the present embodiment, the liquid outflow portion 75 corresponds to a liquid storage chamber communicating with the liquid discharging head 21. The liquid outflow portion 75 is included in the pressure adjustment device 60. Therefore, in the present embodiment, the liquid outflow portion 75 is provided at a position along the direction orthogonal to the width direction X and overlapping with the plane passing through the liquid discharging head 21, similarly to the pressure adjustment device 60.

At least a part of the wall surface of the liquid outflow portion 75 is constituted by the diaphragm 76. The diaphragm 76 receives the pressure of the liquid in the liquid outflow portion 75 on a first surface 76A which is an inner surface of the liquid outflow portion 75. The diaphragm 76 receives the atmospheric pressure on a second surface 76B, which is an outer surface of the liquid outflow portion 75. Therefore, the diaphragm 76 is displaced according to the pressure in the liquid outflow portion 75. The volume of the liquid outflow portion 75 changes due to the displacement of the diaphragm 76. The liquid inflow portion 74 and the liquid outflow portion 75 communicate with each other by a communication path 77.

The pressure adjustment mechanism 71 includes a pressure adjustment opening/closing valve 78. The pressure adjustment opening/closing valve 78 is capable of switching between a valve closed state in which the liquid inflow portion 74 and the liquid outflow portion 75 are blocked in the communication path 77, and a valve open state in which the liquid inflow portion 74 and the liquid outflow portion 75 communicate with each other. The pressure adjustment opening/closing valve 78 includes a valve portion 78A and a pressure receiving portion 78B. The valve portion 78A is configured to be capable of blocking the communication path 77. The pressure receiving portion 78B receives the pressure from the diaphragm 76. The pressure adjustment opening/closing valve 78 is moved when the pressure receiving portion 78B is pressed by the diaphragm 76. That is, the pressure receiving portion 78B also functions as a moving member that is capable of moving in a state in contact with the diaphragm 76 that is displaced in a direction for reducing the volume of the liquid outflow portion 75.

A pressing member 79 is provided in the liquid inflow portion 74. The pressing member 79 presses the pressure adjustment opening/closing valve 78 in a direction for closing the valve. The state of pressure adjustment opening/closing valve 78 is changed from the valve closed state to the valve open state when the pressure applied to the first surface 76A is lower than the pressure applied to the second surface 76B, and a difference between the pressure applied to the first surface 76A and the pressure applied to the second surface 76B is equal to or larger than a predetermined value. As the predetermined value of the first positive pressure adjustment portion 63A, for example, 5.64 kPa is applicable as the first positive pressure.

The predetermined value is a value determined according to the pressing force of the pressing member 79, the force required to displace the diaphragm 76, the sealing load that is the pressing force required to block the communication path 77 by the valve portion 78A, the pressure in the liquid inflow portion 74 acting on the surface of the valve portion 78A, and the pressure in the liquid outflow portion 75. That is, the larger the pressing force of the pressing member 79, the larger the predetermined value for changing the state from the valve closed state to the valve open state.

In the present embodiment, when the pressure adjustment opening/closing valve 78 is in the valve closed state in the pressure adjustment mechanism 71, the pressure of the liquid on the upstream of the pressure adjustment mechanism 71 is normally set to the positive pressure by the pressurization pump 51. Specifically, when the pressure adjustment opening/closing valve 78 is in the valve closed state, the pressure of the liquid inflow portion 74 and the liquid positioned more upstream than the liquid inflow portion 74 are normally set to the positive pressure by the pressurization pump 51.

In the present embodiment, when the pressure adjustment opening/closing valve 78 is in the valve closed state in the pressure adjustment mechanism 71, the pressure of the liquid on the downstream of the pressure adjustment mechanism 71 is normally set to the positive pressure by the diaphragm 76. Specifically, when the pressure adjustment opening/closing valve 78 is in the valve closed state, the pressure of the liquid outflow portion 75 and the liquid positioned more downstream than the liquid outflow portion 75 are normally set to the positive pressure by the diaphragm 76.

When the liquid discharging head 21 discharges the liquid, the liquid accommodated in the liquid outflow portion 75 is supplied to the liquid discharging head 21 via the supply flow path 19. In this case, the pressure in the liquid outflow portion 75 decreases. As a result, when a difference between the pressure applied to the first surface 76A and the pressure applied to the second surface 76B in the diaphragm 76 is equal to or larger than the predetermined value, the diaphragm 76 bends and deforms in a direction for reducing the volume of the liquid outflow portion 75. When the pressure receiving portion 78B is moved by being pressed in accordance with the deformation of the diaphragm 76, the state of the pressure adjustment opening/closing valve 78 becomes the valve open state.

When the pressure adjustment opening/closing valve 78 is in the valve open state, the liquid in the liquid inflow portion 74 is pressurized by the pressurization pump 51, so that the liquid is supplied from the liquid inflow portion 74 to the liquid outflow portion 75. As a result, the pressure inside the liquid outflow portion 75 rises. When the pressure in the liquid outflow portion 75 rises, the diaphragm 76 is deformed so as to increase the volume of the liquid outflow portion 75. When the difference between the pressure applied to the first surface 76A and the pressure applied to the second surface 76B in the diaphragm 76 is smaller than the predetermined value, the state of the pressure adjustment opening/closing valve 78 is changed from the valve open state to the valve closed state. As a result, the pressure adjustment opening/closing valve 78 hinders the flow of the liquid flowing from the liquid inflow portion 74 toward the liquid outflow portion 75.

As described above, the pressure adjustment mechanism 71 adjusts the pressure in the liquid discharging head 21 which is the back pressure of the nozzle 21B by adjusting the pressure of the liquid supplied to the liquid discharging head 21 by the displacement of the diaphragm 76.

The first positive pressure adjustment portion 63A includes a pressing mechanism 72. The pressing mechanism 72 presses the pressure adjustment mechanism 71 via the diaphragm 76. The pressing mechanism 72 includes a presser member 72A.

The presser member 72A is formed so as to have a bottomed cylindrical shape, for example. The presser member 72A forms an air chamber 72B. The air chamber 72B covers the second surface 76B of the diaphragm 76. The air chamber 72B is configured to communicate with the atmosphere through an insertion hole 72C formed in a bottom portion of the presser member 72A. The pressure in the air chamber 72B is defined as the atmospheric pressure. Therefore, the atmospheric pressure acts on the second surface 76B of the diaphragm 76.

The pressing mechanism 72 includes a pressing member 72D. The pressing member 72D is disposed in the air chamber 72B. The pressing member 72D presses the second surface 76B side of the diaphragm 76. The pressing member 72D presses the diaphragm 76 in a direction for reducing the volume of the liquid outflow portion 75. At this time, the pressing member 72D presses a part of the diaphragm 76 that the pressure receiving portion 78B contacts. The area of the part of the diaphragm 76 that the pressure receiving portion 78B contacts is larger than the cross-sectional area of the communication path 77.

In the pressure adjustment opening/closing valve 78, as a force in the valve closing direction, the pressing force of the pressing member 79 and the force due to the liquid pressure applied to the first surface 76A of the diaphragm 76 are mainly generated. Further, in the pressure adjustment opening/closing valve 78, as a force in the valve opening direction, the pressing force of the pressing member 72D and the force due to the atmospheric pressure applied to the second surface 76B of the diaphragm 76 are mainly generated. Regarding the positive pressure that is the set pressure when the first positive pressure adjustment portion 63A is open when the liquid pressure in the liquid outflow portion 75 is lower than the positive pressure of the set pressure, the pressing force (energizing force) of the pressing members 79 and 72D is set such that the force in the valve opening direction exceeds the force in the valve closing direction. In the present embodiment, the second positive pressure adjustment portion 63B has basically the same configuration as the first positive pressure adjustment portion 63A but, for example, the energizing force of the pressing member 79 that determines the positive pressure to open the valve is different.

Figure 9:
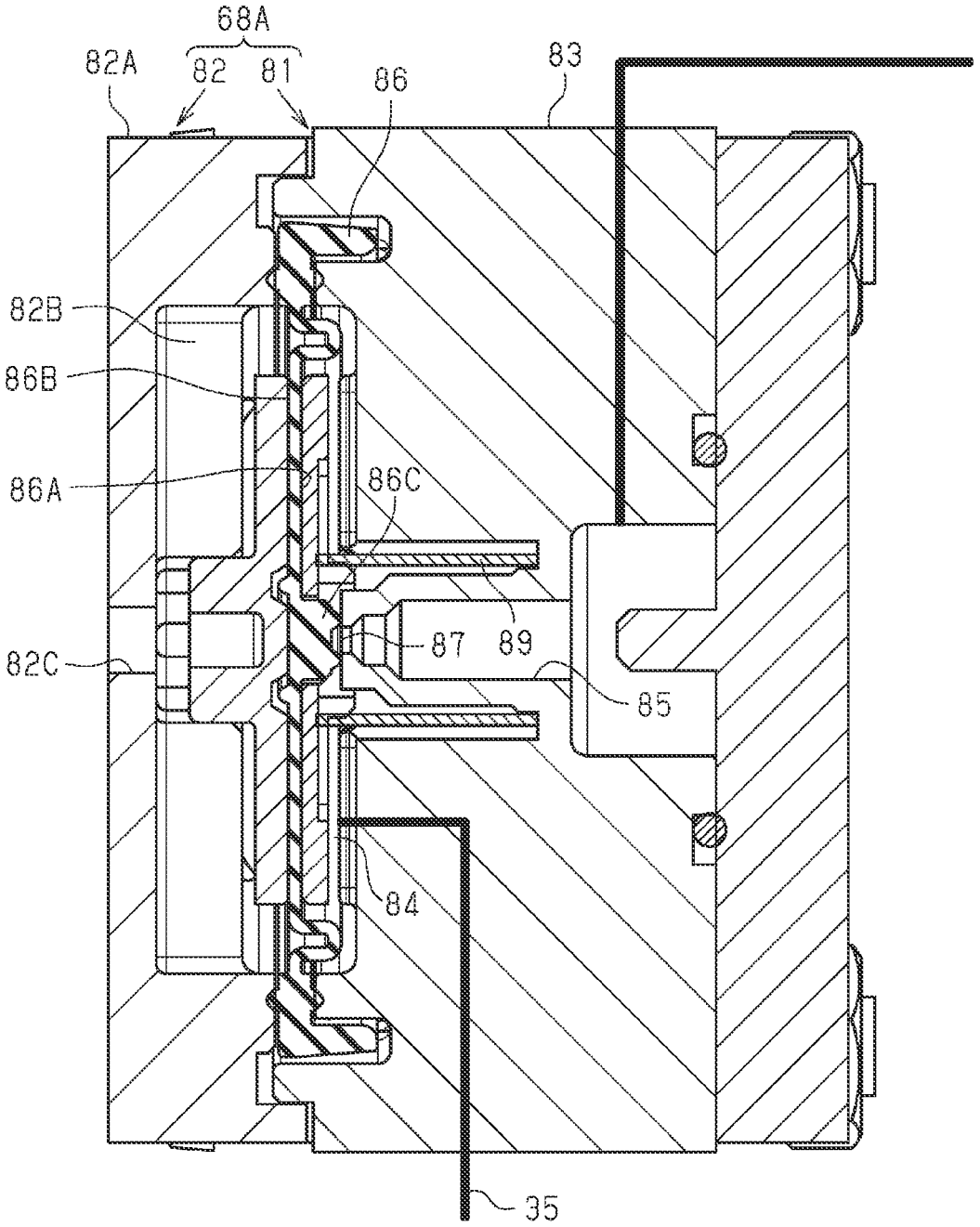
FIG. 9 is a schematic view illustrating an internal configuration of the pressure adjustment portion.

As illustrated in FIG. 9, the first negative pressure adjustment portion 68A includes a pressure adjustment mechanism 81. The pressure adjustment mechanism 81 constitutes a part of the collection flow path 35. The pressure adjustment mechanism 81 includes a main body portion 83. A liquid inflow portion 84 and a liquid outflow portion 85 are formed in the main body portion 83. The liquid to be collected from the liquid discharging head 21 via the collection flow path 35 flows into the liquid inflow portion 84. The liquid outflow portion 85 is configured to be capable of accommodating the liquid inside. In the present embodiment, the liquid inflow portion 84 corresponds to the liquid storage chamber communicating with the liquid discharging head 21. The liquid outflow portion 85 is configured to be capable of accommodating the liquid inside. The liquid inflow portion 84 is included in the pressure adjustment device 60. Therefore, in the present embodiment, the liquid inflow portion 84 is provided at a position along the direction orthogonal to the width direction X and overlapping with the plane passing through the liquid discharging head 21, similarly to the pressure adjustment device 60.

At least a part of the wall surface of the liquid inflow portion 84 is constituted by the diaphragm 86. The diaphragm 86 receives the pressure of the liquid in the liquid inflow portion 84 on a first surface 86A which is an inner surface of the liquid inflow portion 84. The diaphragm 86 receives the atmospheric pressure on a second surface 86B, which is an outer surface of the liquid inflow portion 84. Therefore, the diaphragm 86 is displaced according to the pressure in the liquid inflow portion 84. The volume of the liquid inflow portion 84 changes due to the displacement of the diaphragm 86. The liquid inflow portion 84 and the liquid outflow portion 85 communicate with each other by the communication path 87.

The diaphragm 86 includes a pressure adjustment opening/closing valve portion 86C. The pressure adjustment opening/closing valve portion 86C is capable of switching between a valve closed state in which the liquid inflow portion 84 and the liquid outflow portion 85 are blocked in the communication path 87, and a valve open state in which the liquid inflow portion 84 and the liquid outflow portion 85 communicate with each other. The pressure adjustment opening/closing valve portion 86C is configured to be capable of blocking the communication path 87. The pressure adjustment opening/closing valve portion 86C is moved when the diaphragm 86 is displaced.

A pressing member 89 is provided in the liquid inflow portion 84. The pressing member 89 presses the pressure adjustment opening/closing valve portion 86C in a direction for opening the valve. The state of pressure adjustment opening/closing valve portion 86C is changed from the valve closed state to the valve open state when the pressure applied to the first surface 86A is higher than the pressure applied to the second surface 86B, and a difference between the pressure applied to the first surface 86A and the pressure applied to the second surface 86B is equal to or larger than the predetermined value. As the predetermined value of the first positive pressure adjustment portion 63A, for example, −2.76 kPa is applicable as the first negative pressure.

The predetermined value is a value determined according to the pressing force of the pressing member 89, the force required to displace the diaphragm 86, the sealing load that is the pressing force required to block the communication path 87 by the pressure adjustment opening/closing valve portion 86C, the pressure in the liquid inflow portion 84 acting on the surface of the pressure adjustment opening/closing valve portion 86C, and the pressure in the liquid outflow portion 85. That is, the smaller the pressing force of the pressing member 89, the larger the predetermined value for changing the state from the valve closed state to the valve open state.

In the present embodiment, when the pressure adjustment opening/closing valve portion 86C is in the valve closed state in the pressure adjustment mechanism 81, the pressure of the liquid on the downstream of the pressure adjustment mechanism 81 is normally set to the negative pressure by the depressurization pump 52. Specifically, when the pressure adjustment opening/closing valve portion 86C is in the valve closed state, the pressure of the liquid in the liquid outflow portion 85 and the pressure of the liquid positioned more downstream than the liquid outflow portion 85 are normally set to the negative pressure by the depressurization pump 52.

In the present embodiment, when the pressure adjustment opening/closing valve portion 86C is in the valve closed state in the pressure adjustment mechanism 81, the pressure of the liquid on the upstream of the pressure adjustment mechanism 81 is normally set to the negative pressure by the diaphragm 86. Specifically, when the pressure adjustment opening/closing valve portion 86C is in the valve closed state, the pressure of the liquid in the liquid inflow portion 84 and the pressure of the liquid positioned more upstream than the liquid inflow portion 84 are normally set to the negative pressure by the diaphragm 86.

When the liquid is collected from the liquid discharging head 21, the liquid from the liquid discharging head 21 is collected in the liquid inflow portion 84. In this case, the pressure in the liquid inflow portion 84 rises. As a result, when a difference between the pressure applied to the first surface 86A and the pressure applied to the second surface 86B in the diaphragm 86 is equal to or larger than the predetermined value, the diaphragm 86 bends and deforms in a direction for increasing the volume of the liquid inflow portion 84. The state of the pressure adjustment opening/closing valve portion 86C becomes the valve open state in accordance with the deformation of the diaphragm 86.

When the pressure adjustment opening/closing valve portion 86C is in the valve open state, the liquid in the liquid outflow portion 85 is depressurized by the depressurization pump 52, so that the liquid is collected from the liquid inflow portion 84 to the liquid outflow portion 85. As a result, the pressure in the liquid inflow portion 84 decreases. When the pressure in the liquid inflow portion 84 decreases, the diaphragm 86 deforms so as to reduce the volume of the liquid inflow portion 84. When the difference between the pressure applied to the first surface 86A and the pressure applied to the second surface 86B in the diaphragm 86 is smaller than the predetermined value, the state of the pressure adjustment opening/closing valve portion 86C is changed from the valve open state to the valve closed state. As a result, the pressure adjustment opening/closing valve portion 86C hinders the flow of the liquid flowing from the liquid inflow portion 84 toward the liquid outflow portion 85.

As described above, the pressure adjustment mechanism 81 adjusts the pressure in the liquid discharging head 21 which is the back pressure of the nozzle 21B by adjusting the pressure of the liquid collected from the liquid discharging head 21 by the displacement of the diaphragm 86.

The first negative pressure adjustment portion 68A includes a pressing mechanism 82. The pressing mechanism 82 presses the pressure adjustment mechanism 81 via the diaphragm 86. The pressing mechanism 82 includes a presser member 82A.

The presser member 82A is formed so as to have a bottomed cylindrical shape, for example. The presser member 82A forms an air chamber 82B. The air chamber 82B covers the second surface 86B of the diaphragm 86. The air chamber 82B is configured so as to communicate with the atmosphere through an insertion hole 82C formed in the bottom portion of the presser member 82A. The pressure in the air chamber 82B is defined as the atmospheric pressure. Therefore, the atmospheric pressure acts on the second surface 86B of the diaphragm 86.

In the diaphragm 86, as a force in the valve closing direction of the pressure adjustment opening/closing valve portion 86C, the force due to the application of the atmospheric pressure to the second surface 86B of the diaphragm 86 and the force from the liquid outflow portion 85 side in the pressure adjustment opening/closing valve portion 86C of the diaphragm 86 are mainly generated. Further, in the diaphragm 86, as a force in the valve opening direction of the pressure adjustment opening/closing valve portion 86C, the pressing force of the pressing member 89 and the force due to the liquid pressure applied to the first surface 86A of the diaphragm 86 are mainly generated. Regarding the negative pressure that is the set pressure when the first negative pressure adjustment portion 68A is open when the liquid pressure in the liquid inflow portion 84 is higher than the negative pressure of the set pressure, the pressing force (energizing force) of the pressing member 89 is set such that the force in the valve opening direction exceeds the force in the valve closing direction. In the present embodiment, the second negative pressure adjustment portion 68B has basically the same configuration as the first negative pressure adjustment portion 68A but, for example, the energizing force of the pressing member 89 that determines the negative pressure to open the valve is different.

Figure 10:
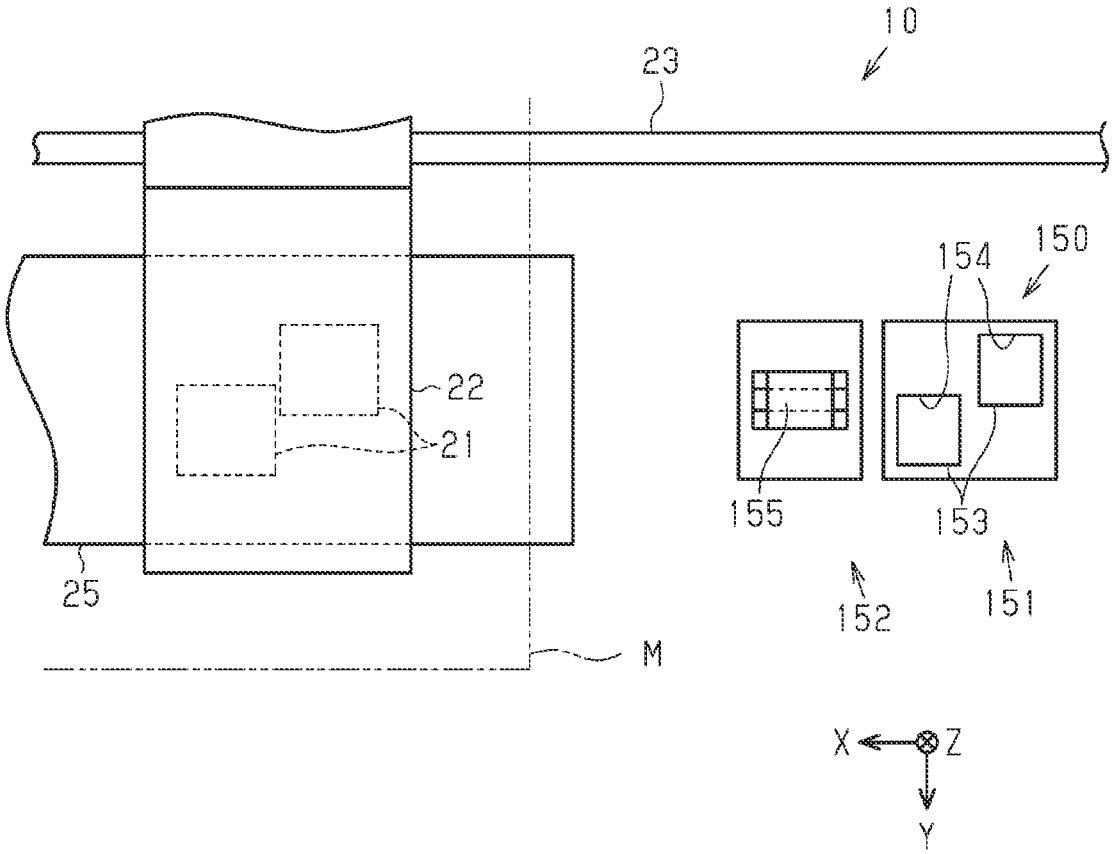
FIG. 10 is a plan view schematically illustrating an internal structure of the liquid discharging apparatus.

As illustrated in FIG. 10, the liquid discharging apparatus 10 includes a maintenance device 150. The maintenance device 150 may include a cap mechanism 151 and a wiping mechanism 152. In the present embodiment, the cap mechanism 151 and the wiping mechanism 152 are provided in a non-recording area in the liquid discharging apparatus 10. In the present embodiment, the non-recording area is an area in which the liquid discharging head 21 does not face the medium M being transported. The non-recording area is an area in which the liquid is not discharged to the medium M. That is, the non-recording area is an area adjacent to the support base 25 in the width direction X.

The cap mechanism 151 caps the nozzle 21B by contacting the cap 153 with the nozzle surface 21A of the liquid discharging head 21 during the non-recording. Further, the cap 153 also serves as a liquid receiving portion that receives the liquid discharged from the nozzle 21B of the liquid discharging head 21 by flushing. The flushing is an operation of discharging liquid unrelated to printing from the nozzle 21B for the purpose of preventing and eliminating clogging or the like of the nozzle 21B. The cap 153 is formed in a box shape having an opening 154 that opens toward a moving area of the carriage 22. When the flushing is executed, the liquid discharging head 21 discharges the liquid toward the opening 154 of the cap 153.

The wiping mechanism 152 is configured to wipe the nozzle surface 21A in a state where the liquid discharging head 21 is positioned above the wiping mechanism 152. The wiping is an operation of wiping the nozzle surface 21A in order to remove foreign substances such as liquid and dust adhering to the nozzle surface 21A. The wiping mechanism 152 wipes the nozzle surface 21A by a wiping portion 155.

Next, the electrical configuration of the liquid discharging apparatus 10 will be described with reference to FIG. 11.

Figure 11:
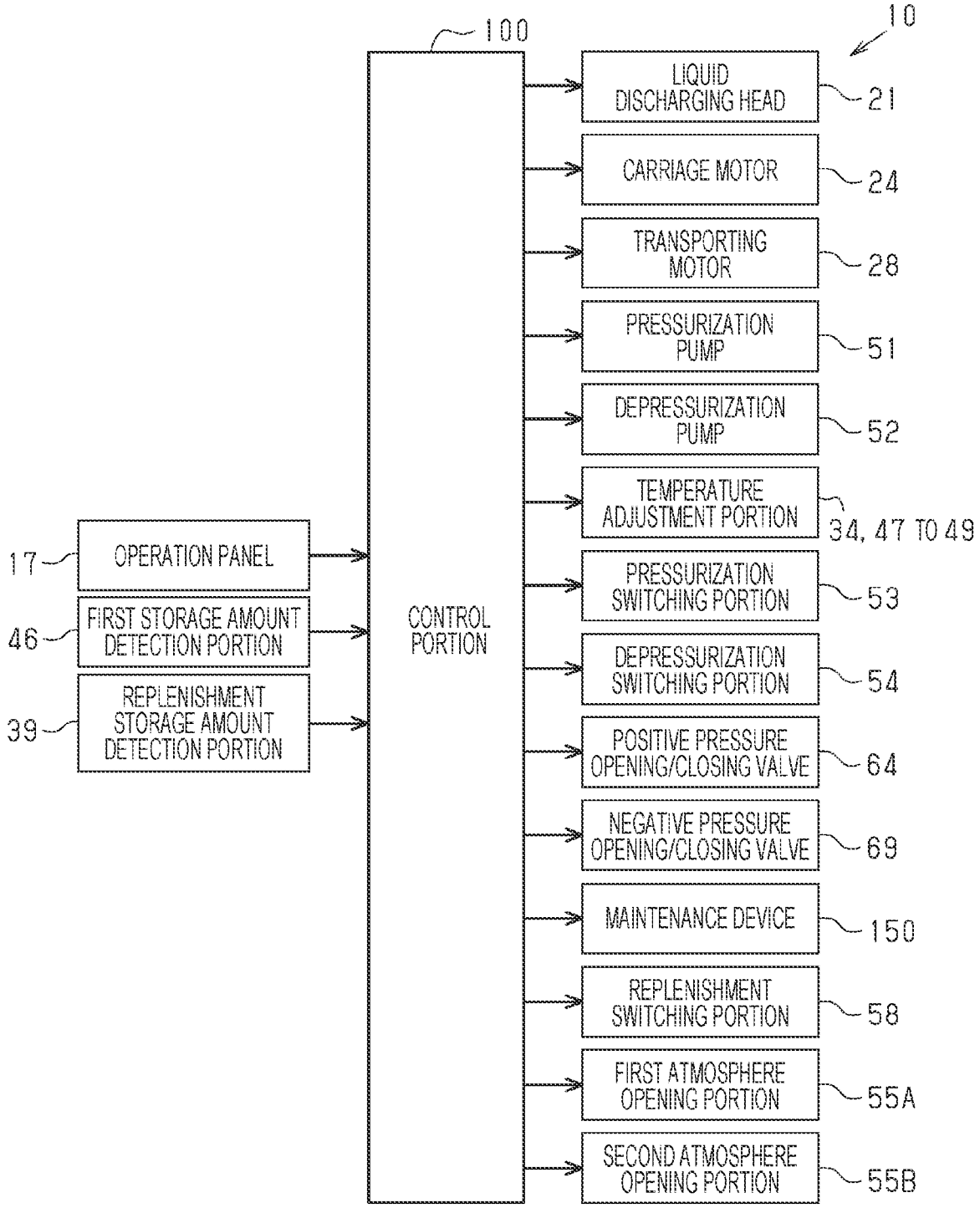
FIG. 11 is a block view illustrating an electrical configuration of the liquid discharging apparatus.

As illustrated in FIG. 11, the liquid discharging apparatus 10 includes the control portion 100 that comprehensively controls the components of the liquid discharging apparatus 10.

The control portion 100 includes a CPU and a memory portion. The CPU is an arithmetic processing device that executes a predetermined arithmetic processing. The memory portion is a memory device to which an area for storing a CPU program or a work area can be allocated. The memory portion has a memory device such as RAM or EEPROM. The CPU performs various controls of the liquid discharging apparatus 10 according to a program stored in the memory portion.

The control portion 100 is coupled to the operation panel 17, the first storage amount detection portion 46, and the replenishment storage amount detection portion 39. The control portion 100 performs various controls based on signals from the operation panel 17, the first storage amount detection portion 46, and the replenishment storage amount detection portion 39. The control portion 100 is coupled to the liquid discharging head 21, the carriage motor 24, transporting motor 28, and the maintenance device 150. The control portion 100 performs various controls by transmitting control signals to the liquid discharging head 21, the carriage motor 24, the transporting motor 28, and the maintenance device 150. The control portion 100 is coupled to the pressurization pump 51, the depressurization pump 52, the temperature adjustment portions 34, 47 to 49, the pressurization switching portion 53, the depressurization switching portion 54, the replenishment switching portion 58, the first atmosphere opening portion 55A, the second atmosphere opening portion 55B, the positive pressure opening/closing valve 64, and the negative pressure opening/closing valve 69. The control portion 100 performs various controls by transmitting the control signals to the pressurization pump 51, the depressurization pump 52, the temperature adjustment portions 34, 47 to 49, the pressurization switching portion 53, the depressurization switching portion 54, the replenishment switching portion 58, the first atmosphere opening portion 55A, the second atmosphere opening portion 55B, the positive pressure opening/closing valve 64, and the negative pressure opening/closing valve 69.

As described above, in the present embodiment, the control portion 100 controls at least the liquid discharging head 21 and the liquid circulation device 30. Further, the control portion 100 performs circulation of the liquid by controlling the depressurization by the depressurization pump 52, the pressurization by the pressurization pump 51, the switching by the depressurization switching portion 54, and the switching by the pressurization switching portion 53.

Here, the circulation control process will be described with reference to FIGS. 12 and 13. The circulation control process is a subroutine called by the control portion 100 at predetermined periods.

Figure 12:
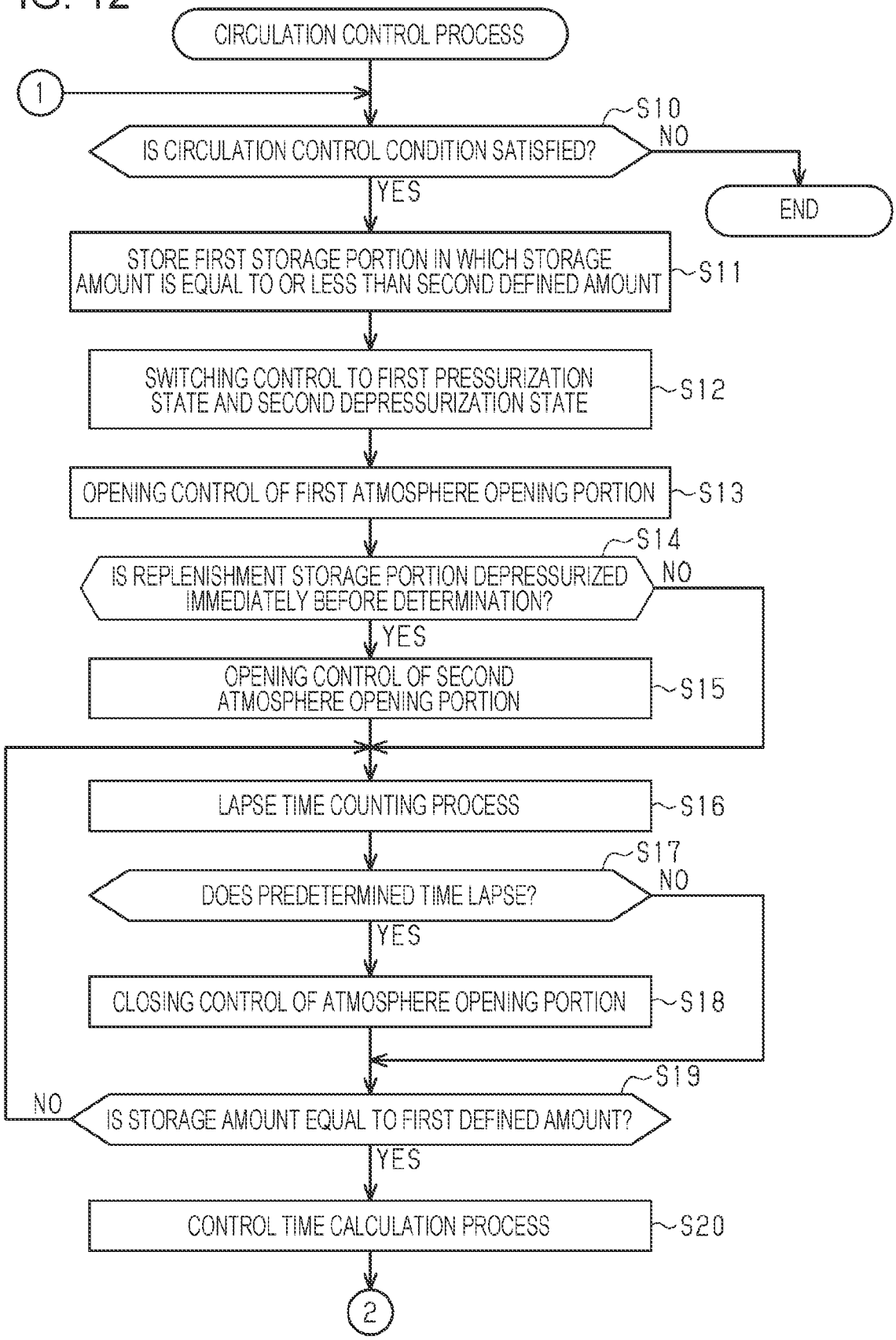
FIG. 12 is a flowchart illustrating a circulation control process of the liquid discharging apparatus.

As illustrated in FIG. 12, in step S10, the control portion 100 determines whether or not a circulation control condition is satisfied. In the present embodiment, the circulation control condition is satisfied when the printing is performed, when the power is turned on when returning from sleep, or the like. When the control portion 100 determines that the circulation control condition is not satisfied, the control portion 100 ends the circulation control process. On the other hand, when the control portion 100 determines that the circulation control condition is satisfied, the control portion 100 shifts the process to step S11.

In step S11, the control portion 100 determines whether or not each of the plurality of first storage portions 41 is the first storage portion 41 in which the storage amount of the liquid is equal to or less than the second defined amount of the liquid, based on the signal from the first storage amount detection portion 46. When the control portion 100 determines that the storage amount of liquid of the first storage portion 41 is equal to or less than the second defined amount, the control portion 100 stores information that can be used for identifying the first storage portion 41 in the memory portion. As a result, the control portion 100 is capable of identifying the first storage portion 41 in which the storage amount of the liquid is equal to or less than the second defined amount. When this process is ended, the control portion 100 shifts the process to step S12.

In step S12, the control portion 100 performs switching control for switching the states to the first pressurization state and the second depressurization state. Specifically, the control portion 100 switches the state of the pressurization switching portion 53 to the first pressurization state and controls the pressurization pump 51 to pressurize the replenishment storage portion 31. The control portion 100 switches the state of the depressurization switching portion 54 to the second depressurization state and controls the depressurization pump 52 to depressurize the third storage portion 43.

As a result, as illustrated in FIG. 4, the control portion 100 can supply the liquid, which is stored in the first storage portion 41, to the liquid discharging head 21 via the supply flow path 19. The control portion 100 can collect the liquid, which is stored in the second storage portion 42, in the third storage portion 43 via the second collection flow path 35B.

Further, as illustrated in FIG. 6, when the liquid is stored in the replenishment storage portion 31, the control portion 100 can also supply the liquid, which is stored in the replenishment storage portion 31, to the first storage portion 41 via the supply flow path 19. When this process is ended, the control portion 100 shifts the process to step S13.

In step S13, the control portion 100 performs opening control to open the first atmosphere opening portion 55A and makes the third storage portion 43 communicate with the atmosphere. As a result, the control portion 100 can quickly switch from pressurization to depressurization of the third storage portion 43 even when the third storage portion 43 is pressurized by the pressurization pump 51 immediately before the switching. When this process is ended, the control portion 100 shifts the process to step S14.

In step S14, the control portion 100 determines whether or not the replenishment storage portion 31 is depressurized immediately before the determination. In this process, the control portion 100 determines that the replenishment storage portion 31 is depressurized immediately before the determination when at least any one of the plurality of replenishment switching portions 58 is controlled to be in the first communication state immediately before the determination. When the control portion 100 determines that the replenishment storage portion 31 is not depressurized immediately before the determination, the control portion 100 shifts the process to step S16 without executing step S15. On the other hand, when the control portion 100 determines that the replenishment storage portion 31 is depressurized immediately before the determination, the control portion 100 shifts the process to step S15.

In step S15, the control portion 100 performs the opening control to open the second atmosphere opening portion 55B and makes the replenishment storage portion 31 communicate with the atmosphere. As a result, the control portion 100 can quickly switch from depressurization to pressurization of the replenishment storage portion 31 even when the replenishment storage portion 31 is depressurized by the depressurization pump 52 immediately before the switching. When this process is ended, the control portion 100 shifts the process to step S16.

In step S16, the control portion 100 executes a lapse time counting process for counting the lapse time lapsed since the performance of the switching control for switching the states to the first pressurization state and the second depressurization state. When this process is ended, the control portion 100 shifts the process to step S17.

In step S17, the control portion 100 determines whether or not a predetermined time lapsed based on the counting result of the lapse time. In the present embodiment, the predetermined time is a control time for opening the first atmosphere opening portion 55A and the second atmosphere opening portion 55B and, for example, is is applicable, but the present disclosure is not limited to this. When the control portion 100 determines that the predetermined time does not lapse, the control portion 100 shifts the process to step S19 without executing step S18. On the other hand, when the control portion 100 determines that the predetermined time lapsed, the control portion 100 shifts the process to step S18.

In step S18, the control portion 100 performs closing control to close the atmosphere opening portion which is under the opening control. Specifically, the control portion 100 performs the closing control for closing the first atmosphere opening portion 55A, which is under the opening control. When the second atmosphere opening portion 55B is under the opening control, the control portion 100 performs the closing control to close the second atmosphere opening portion 55B, which is under the opening control. When this process is ended, the control portion 100 shifts the process to step S19.

In step S19, the control portion 100 determines whether or not there is a first storage portion 41 in which the storage amount of the liquid is equal to or less than the first defined amount among the plurality of first storage portions 41, based on the signal from the first storage amount detection portion 46. In the present embodiment, as the first defined amount, an amount, in which the liquid stored in the first storage portion 41 does not run out, is adopted by using the switching time required for switching of the pressurization switching portion 53 and the depressurization switching portion 54, the flow rate of the liquid, and the like. When the control portion 100 determines that there is no first storage portion 41 in which the storage amount of the liquid is equal to or less than the first defined amount, the control portion 100 shifts the process to step S16 without shifting to step S20. When the control portion 100 determines that there is a first storage portion 41 in which the storage amount of the liquid is equal to or less than the first defined amount, the control portion 100 shifts the process to step S20. As a result, the control portion 100 repeatedly executes steps S16 to S19 until it is determined that there is a first storage portion 41 in which the storage amount of liquid is equal to or less than the first defined amount.

In the present embodiment, the plurality of first storage portions 41 have the same shape, and the level of the liquid has a predetermined height when the storage amount of liquid is proportional to the height of the level of the liquid, and the storage amount of liquid is the first defined amount. Therefore, in a case where there is a first storage portion 41 in which the level of the liquid is lower than a predetermined height among the plurality of first storage portions 41 when the pressurization pump 51 pressurizes the plurality of first storage portions 41, the control portion 100 switches the state of the pressurization switching portion 53 to the second pressurization state. As a result, the liquid is collected from the plurality of third storage portions 43 to the plurality of first storage portions 41.

In step S20, the control portion 100 executes the control time calculation process. In this process, the control portion 100 calculates the control time for the next switching control based on the lapse time counted in step S16. In the present embodiment, the control portion 100 calculates time 1.2 times the counted lapse time, as control time, for example. In the present embodiment, as for the control time, a calculation method is adopted so that all the liquid stored in the third storage portion 43 is collected in the first storage portion 41. When this process is ended, the control portion 100 shifts the process to step S21 in FIG. 13.

Figure 13:
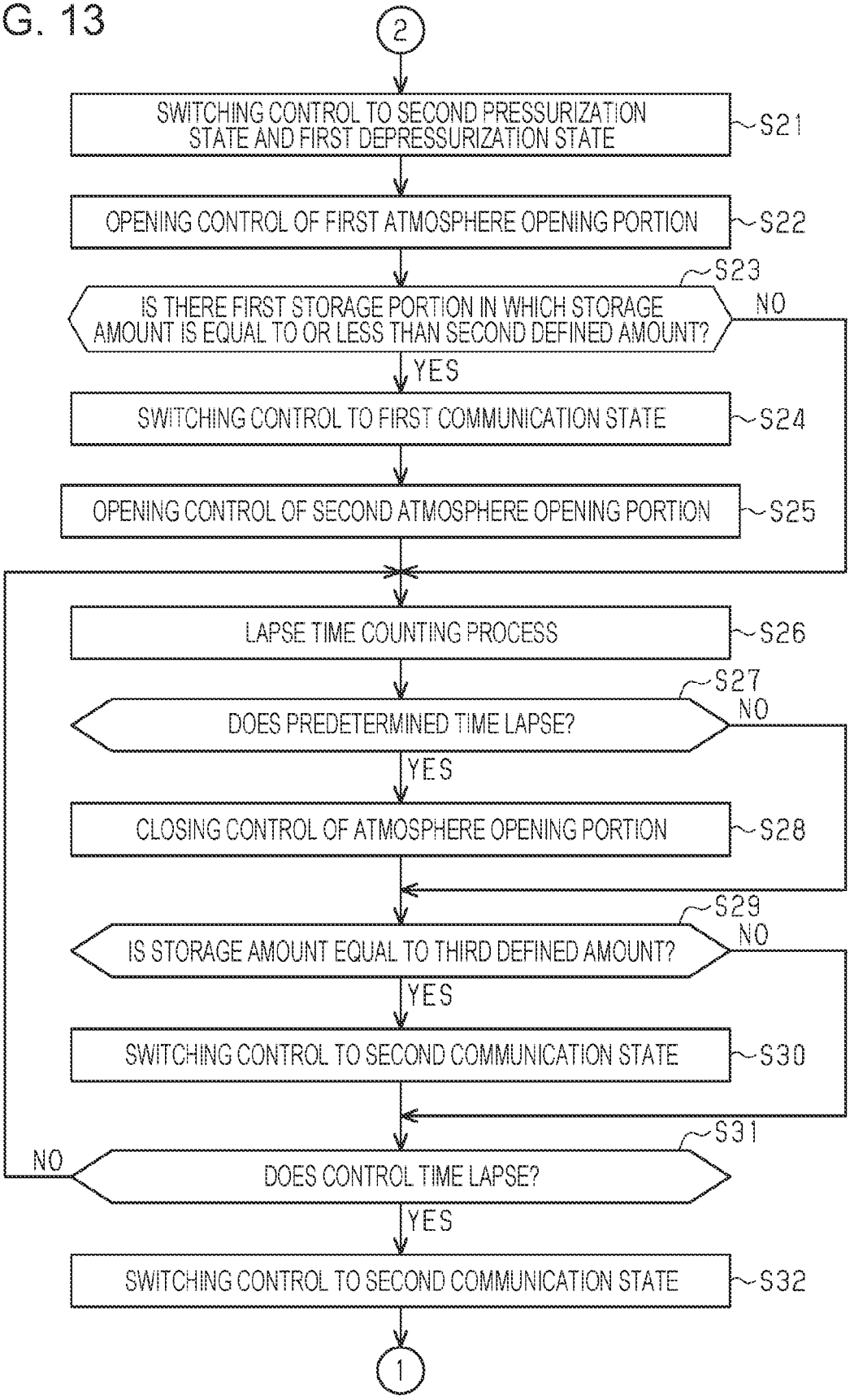
FIG. 13 is a flowchart illustrating the circulation control process of the liquid discharging apparatus.

As illustrated in FIG. 13, in step S21, the control portion 100 performs the switching control for switching the states to the second pressurization state and the first depressurization state. Specifically, the control portion 100 switches the state of the pressurization switching portion 53 to the second pressurization state and controls the pressurization pump 51 to pressurize the third storage portion 43. The control portion 100 switches the state of the depressurization switching portion 54 to the first depressurization state and controls the depressurization pump 52 to depressurize the second storage portion 42.

As a result, as illustrated in FIG. 5, the control portion 100 can collect the liquid from the liquid discharging head 21 to the second storage portion 42 via the first collection flow path 35A. The control portion 100 can collect the liquid stored in the third storage portion 43 to the first storage portion 41 via the third collection flow path 35C. When this process is ended, the control portion 100 shifts the process to step S22.

In step S22, the control portion 100 performs opening control to open the first atmosphere opening portion 55A and makes the third storage portion 43 communicate with the atmosphere. As a result, the control portion 100 can quickly switch from depressurization to pressurization of the third storage portion 43 even when the third storage portion 43 is depressurized by the depressurization pump 52 immediately before the switching. When this process is ended, the control portion 100 shifts the process to step S23.

In step S23, the control portion 100 determines whether or not there is a first storage portion 41 in which the storage amount of the liquid is equal to or less than the second defined amount, based on the determination result in step S11 in FIG. 12. When the control portion 100 determines that there is no first storage portion 41 in which the storage amount of the liquid is equal to or less than the second defined amount, the control portion 100 shifts the process to step S26 without executing steps S24 and S25. On the other hand, when the control portion 100 determines that there is a first storage portion 41 in which the storage amount of the liquid is equal to or less than the second defined amount, the control portion 100 shifts the process to step S24.

In step S24, the control portion 100 performs the switching control for switching the state to the first communication state. Specifically, the control portion 100 switches the state of the replenishment switching portion 58 corresponding to the first storage portion 41, in which the storage amount of the liquid is equal to or less than the second defined amount, to the first communication state, and controls such that the replenishment storage portion 31 is depressurized by the depressurization pump 52 via the second communication flow path 38J. On the other hand, the control portion 100 controls such that the state is continuously in the second communication state without switching the replenishment switching portion 58 corresponding to the first storage portion 41, in which the storage amount of the liquid is not less than or equal to the second defined amount, to the first communication state.

As a result, as illustrated in FIG. 7, even when the first storage portion 41 cannot be sufficiently replenished with the liquid from the third storage portion 43, the control portion 100 can supply the liquid from the liquid supply source 18 to the replenishment storage portion 31 via the supply flow path 19 and replenish the first storage portion 41 with the liquid from the replenishment storage portion 31. When this process is ended, the control portion 100 shifts the process to step S25.

In step S25, the control portion 100 performs the opening control to open the second atmosphere opening portion 55B and makes the replenishment storage portion 31 communicate with the atmosphere. As a result, the control portion 100 can quickly switch from pressurization to depressurization of the replenishment storage portion 31 even when the replenishment storage portion 31 is pressurized by the pressurization pump 51 immediately before the switching. When this process is ended, the control portion 100 shifts the process to step S26.

In step S26, the control portion 100 executes a lapse time counting process for counting the lapse time lapsed since the performance of the switching control for switching the states to the second pressurization state and the first depressurization state. When this process is ended, the control portion 100 shifts the process to step S27.

In step S27, the control portion 100 determines whether or not a predetermined time lapsed based on the counting result of the lapse time. In the present embodiment, the predetermined time is a control time for opening the first atmosphere opening portion 55A and the second atmosphere opening portion 55B and, for example, is is applicable, but the present disclosure is not limited to this. When the control portion 100 determines that the predetermined time does not lapse, the control portion 100 shifts the process to step S29 without executing step S28. On the other hand, when the control portion 100 determines that the predetermined time lapsed, the control portion 100 shifts the process to step S28.

In step S28, the control portion 100 performs closing control to close the atmosphere opening portion which is under the opening control. Specifically, the control portion 100 performs the closing control for closing the first atmosphere opening portion 55A, which is under the opening control. When the second atmosphere opening portion 55B is under the opening control, the control portion 100 performs the closing control to close the second atmosphere opening portion 55B, which is under the opening control. When this process is ended, the control portion 100 shifts the process to step S29.

In step S29, the control portion 100 determines whether or not there is a replenishment storage portion 31, which is depressurized by the depressurization pump 52 and has the storage amount of the liquid equal to the third defined amount, among the plurality of replenishment storage portions 31, based on the signal from the replenishment storage amount detection portion 39. When the control portion 100 determines that there is no replenishment storage portion 31 in which the storage amount of the liquid is equal to the third defined amount, the control portion 100 shifts the process to step S31 without shifting to step S30. On the other hand, when the control portion 100 determines that there is a replenishment storage portion 31 in which the storage amount of the liquid is equal to the third defined amount, the control portion 100 shifts the process to step S30.

In step S30, the control portion 100 performs the switching control for switching the state to the second communication state. Specifically, the control portion 100 switches the state of the replenishment switching portion 58 corresponding to the replenishment storage portion 31, in which the storage amount of the liquid is equal to the third defined amount, to the second communication state, and controls such that the replenishment storage portion 31 is not depressurized by the depressurization pump 52 via the second communication flow path 38J. On the other hand, the control portion 100 controls such that the state is continuously in the first communication state without switching the replenishment switching portion 58 corresponding to the replenishment storage portion 31, in which the storage amount of the liquid is not equal to the third defined amount, to the second communication state. When this process is ended, the control portion 100 shifts the process to step S31.

In step S31, the control portion 100 determines whether or not the control time, which is determined in step S20 in FIG. 12, lapsed based on the counting result of the lapse time. When the control portion 100 determines that the control time does not lapse, the control portion 100 shifts the process to step S26 without shifting to step S32. On the other hand, when the control portion 100 determines that the control time lapsed, the control portion 100 shifts the process to step S32. As a result, the control portion 100 repeatedly executes steps S26 to S31 until the control time lapses.

In step S32, the control portion 100 performs the switching control for switching the state to the second communication state. Specifically, the control portion 100 switches the states of the plurality of replenishment switching portions 58 corresponding to each of the plurality of replenishment storage portions 31 to the second communication state, and controls such that the replenishment storage portion 31 is not depressurized by the depressurization pump 52 via the second communication flow path 38J. When the plurality of replenishment switching portions 58 corresponding to each of the plurality of replenishment storage portions 31 are already in the second communication state, the control portion 100 controls such that the state is continuously the second communication state. When this process is ended, the control portion 100 shifts the process to step S10.

In the present embodiment, from the calculation of the control time in step S20, the time controlled in the second pressurization state and the first depressurization state is longer than the time controlled in the first pressurization state and the second depressurization state. As described above, the control portion 100 collects the liquid from the second storage portion 42 to the third storage portion 43 by switching the state of the depressurization switching portion 54 to the second depressurization state and depressurizing the third storage portion 43 over a first time in the second depressurization state. After that, the control portion 100 collects the liquid from the third storage portion 43 to the first storage portion 41 by switching the state of the pressurization switching portion 53 to the second pressurization state and pressurizing the third storage portion 43 over a second time longer than the first time in the second pressurization state.

In the present embodiment, the control portion 100 controls the first positive pressure opening/closing valve 64A, the second positive pressure opening/closing valve 64B, the first negative pressure opening/closing valve 69A, and the second negative pressure opening/closing valve 69B depending on a control status of the liquid discharging apparatus 10.

In the present embodiment, although the opening control of the first atmosphere opening portion 55A and the second atmosphere opening portion 55B is performed after performing the switching control for switching the state to the first pressurization state and the second depressurization state, for example, the opening control may be performed at the same time as the switching control, and for example, the switching control may be performed after the opening control is performed.

In the present embodiment, although the opening control of the first atmosphere opening portion 55A and the second atmosphere opening portion 55B is performed after performing the switching control for switching the state to the second pressurization state and the first depressurization state, for example, the opening control may be performed at the same time as the switching control, and for example, the switching control may be performed after the opening control is performed.

The content of the control executed by the control portion 100 will be described with reference to FIG. 14.

As illustrated in FIG. 14, when printing is performed as the control status of the liquid discharging apparatus 10, the control portion 100 performs a normal circulation control. In the normal circulation control, the control portion 100 controls so as to open the first positive pressure opening/closing valve 64A and the first negative pressure opening/closing valve 69A and close the second positive pressure opening/closing valve 64B and the second negative pressure opening/closing valve 69B.

Next, as the control status of the liquid discharging apparatus 10, the control portion 100 performs a high speed circulation control when the power is turned on and when returning from sleep. In the high speed circulation control, the control portion 100 controls so as to open the second positive pressure opening/closing valve 64B and the second negative pressure opening/closing valve 69B and close the first positive pressure opening/closing valve 64A and the first negative pressure opening/closing valve 69A.

Next, as the control status of the liquid discharging apparatus 10, the control portion 100 performs a nozzle air exhaust circulation control when an air bubble exhaust is performed from the nozzle 21B. When the air bubble exhaust is performed from the nozzle 21B, the control portion 100 discharges the liquid in the liquid discharging head 21 at a high speed. In the nozzle air exhaust circulation control, the control portion 100 controls so as to open the second positive pressure opening/closing valve 64B and close the first positive pressure opening/closing valve 64A, the first negative pressure opening/closing valve 69A, and the second negative pressure opening/closing valve 69B.

Next, when performing the wiping of the nozzle surface 21A, the control portion 100 performs a wiping circulation control. In the wiping circulation control, the control portion 100 controls so as to close the first positive pressure opening/closing valve 64A, the second positive pressure opening/closing valve 64B, the first negative pressure opening/closing valve 69A, and the second negative pressure opening/closing valve 69B.

Finally, as the control status of the liquid discharging apparatus 10, the control portion 100 performs a neglected circulation control during the neglecting time, which is not the control status described above. In the neglected circulation control, the control portion 100 controls so as to open the first negative pressure opening/closing valve 69A and close the first positive pressure opening/closing valve 64A, the second positive pressure opening/closing valve 64B, and second negative pressure opening/closing valve 69B.

The operation of the present embodiment will be described.

First, as illustrated in FIG. 4, the pressurization switching portion 53 is controlled to be in the first pressurization state, the depressurization switching portion 54 is controlled to be in the second depressurization state, and the replenishment switching portion 58 is controlled to be in the second communication state.

When the pressurization switching portion 53 is controlled to be in the first pressurization state, the pressurization pump 51 and the replenishment storage portion 31 communicate with each other. The replenishment storage portion 31 is pressurized by the pressurization pump 51. The first storage portion 41 communicates with the replenishment storage portion 31. The first storage portion 41 is pressurized by the pressurization pump 51. As a result, the liquid stored in the first storage portion 41 is supplied to the liquid discharging head 21 via the supply flow path 19.

When the depressurization switching portion 54 is controlled to be in the second depressurization state, the depressurization pump 52 and the third storage portion 43 communicate with each other. The third storage portion 43 is depressurized by the depressurization pump 52. As a result, the liquid stored in the second storage portion 42 is collected in the third storage portion 43 via the second collection flow path 35B. In this case, the second check valve 45 is provided in the third collection flow path 35C that makes the first storage portion 41 and the third storage portion 43 communicate with each other, the liquid stored in the first storage portion 41 does not flow to the third storage portion 43, and the liquid does not flow back to the collection flow path 35.

When the replenishment switching portion 58 is controlled to be in the second communication state, the replenishment communication flow path 38H communicates with the first atmosphere communication path 38I without communicating with the replenishment storage portion 31. Therefore, the replenishment storage portion 31 is not depressurized by the depressurization pump 52. When the negative pressure in the second storage portion 42 is lower than the predetermined negative pressure, the atmosphere is taken into the second storage portion 42 by opening the first negative pressure opening portion 57 and the second negative pressure opening portion 59. As a result, it is possible to reduce the excessive negative pressure of the second storage portion 42.

Next, as illustrated in FIG. 5, when the storage amount of liquid, which is stored in at least any one of the plurality of first storage portions 41, is equal to the first defined amount, the pressurization switching portion 53 is controlled to be in the second pressurization state, the depressurization switching portion 54 is controlled to be in the first depressurization state, and the replenishment switching portion 58 is controlled to be in the second communication state.

When the pressurization switching portion 53 is controlled to be in the second pressurization state, the pressurization pump 51 and the third storage portion 43 communicate with each other. The third storage portion 43 is pressurized by the pressurization pump 51. As a result, the liquid stored in the third storage portion 43 is collected in the first storage portion 41 via the third collection flow path 35C.

When the depressurization switching portion 54 is controlled to be in the first depressurization state, the depressurization pump 52 and the second storage portion 42 communicate with each other. The second storage portion 42 is depressurized by the depressurization pump 52. As a result, the liquid in the liquid discharging head 21 is collected in the second storage portion 42 via the first collection flow path 35A. In this case, the first check valve 44 is provided in the second collection flow path 35B that makes the second storage portion 42 and the third storage portion 43 communicate with each other, the liquid stored in the third storage portion 43 does not flow to the second storage portion 42, and the liquid does not flow back to the collection flow path 35.

As illustrated in FIG. 6, in a case where the pressurization switching portion 53 is controlled to be in the first pressurization state when the liquid is stored in the replenishment storage portion 31, the pressurization pump 51 and the replenishment storage portion 31 communicate with each other. The replenishment storage portion 31 is pressurized by the pressurization pump 51. As a result, the liquid stored in the replenishment storage portion 31 is supplied to the first storage portion 41.

As illustrated in FIG. 7, as a result of controlling each of the pressurization switching portion 53 to be in the second pressurization state and the depressurization switching portion 54 to be in the first depressurization state, the replenishment switching portion 58 corresponding to the first storage portion 41 is controlled to be in the first communication state, among the plurality of first storage portions 41 when there is a first storage portion 41 in which the storage amount of liquid stored therein is equal to or less than the second defined amount.

When the replenishment switching portion 58 is controlled to be in the first communication state, the replenishment communication flow path 38H communicates with the replenishment storage portion 31. Therefore, the replenishment storage portion 31 is depressurized by the depressurization pump 52 via the second storage portion 42. As a result, the liquid in the liquid supply source 18 is supplied to the replenishment storage portion 31 via the supply flow path 19. In this case, the discharge valve 33 is provided between the replenishment storage portion 31 and the first storage portion 41 in the supply flow path 19, the liquid stored in the first storage portion 41 does not flow in the replenishment storage portion 31, and the liquid does not flow back to the supply flow path 19.

In a case where the replenishment switching portion 58 is controlled to be in the first communication state when the storage amount of liquid, which is stored in the replenishment storage portion 31, is equal to the third defined amount, the replenishment switching portion 58 is controlled to be the second communication state. As a result, the replenishment storage portion 31 is not supplied with the liquid exceeding the third defined amount.

As described above, by repeatedly switching between the state illustrated in FIG. 4 and the state illustrated in FIG. 5, the liquid can be circulated in the path passing through the liquid discharging head 21 via the supply flow path 19 and the collection flow path 35. Further, when the liquid flowing in the circulation flow path 36 is insufficient due to the consumption of the liquid by the liquid discharging head 21, the circulation flow path 36 can be replenished with the liquid from the liquid supply source 18 by controlling the state to the state illustrated in FIGS. 6 and 7.

The third storage portion 43 is pressurized by the pressurization pump 51 by controlling the pressurization switching portion 53 to be in the second pressurization state. The third storage portion 43 is depressurized by the depressurization pump 52 by controlling the depressurization switching portion 54 to be in the second depressurization state. As described above, when the pressurization and the depressurization are switched in the third storage portion 43, the atmosphere is taken into the third storage portion 43 by opening the first atmosphere opening portion 55A over a predetermined time. As a result, it is possible to quickly switch between the pressurization and the depressurization in the third storage portion 43.

The replenishment storage portion 31 is pressurized by the pressurization pump 51 by controlling the pressurization switching portion 53 to be in the first pressurization state. The replenishment storage portion 31 is depressurized by the depressurization pump 52 by controlling the replenishment switching portion 58 to be in the first communication state. As described above, when the pressurization by the pressurization pump 51 and the depressurization by the depressurization pump 52 are switched, the atmosphere is taken into the replenishment storage portion 31 by opening the second atmosphere opening portion 55B over the predetermined time. As a result, it is possible to quickly switch between pressurization and depressurization in the replenishment storage portion 31.

The first storage portion 41 is pressurized by the pressurization pump 51 via the replenishment storage portion 31 by controlling the pressurization switching portion 53 to be in the first pressurization state. When the positive pressure in the first storage portion 41 is higher than the predetermined positive pressure, the atmosphere is taken into the first storage portion 41 by opening the pressurization opening portion 56. As a result, it is possible to reduce the excessive pressurization of the first storage portion 41.

Further, in the pressure adjustment device 60, the first positive pressure opening/closing valve 64A, the second positive pressure opening/closing valve 64B, the first negative pressure opening/closing valve 69A, and the second negative pressure opening/closing valve 69B are controlled depending on the control status of the liquid discharging apparatus 10.

Specifically, when the printing is performed, the first positive pressure opening/closing valve 64A is open in the supply flow path 19, and the first negative pressure opening/closing valve 69A is open in the collection flow path 35. When the first positive pressure opening/closing valve 64A is open, the pressure on the liquid discharging head 21 side becomes the first positive pressure in the first positive pressure adjustment portion 63A, and then the first positive pressure adjustment portion 63A is open. As a result, the liquid flows in the supply flow path 19 in a state where the first positive pressure is received. When the first negative pressure opening/closing valve 69A is open, the pressure on the liquid discharging head 21 side becomes the first negative pressure in the first negative pressure adjustment portion 68A, and then the first negative pressure adjustment portion 68A is open. As a result, the liquid flows in the collection flow path 35 in a state where the first negative pressure is received.

Next, when the power is turned on and when returning from sleep, the second positive pressure opening/closing valve 64B is open in the supply flow path 19, and the second negative pressure opening/closing valve 69B is open in the collection flow path 35. When the second positive pressure opening/closing valve 64B is open, the pressure on the liquid discharging head 21 side becomes the second positive pressure in the second positive pressure adjustment portion 63B, and then the second positive pressure adjustment portion 63B is open. As a result, the liquid flows in the supply flow path 19 in a state where the second positive pressure is received. When the second negative pressure opening/closing valve 69B is open, the pressure on the liquid discharging head 21 side becomes the second negative pressure in the second negative pressure adjustment portion 68B, and then the second negative pressure adjustment portion 68B is open. As a result, the liquid flows in the collection flow path 35 in a state where the second negative pressure is received.

The second positive pressure is larger than the first positive pressure. The second negative pressure is larger in absolute value than the first negative pressure. When the power is turned on and when returning from sleep, there is a higher possibility that air bubbles are generated in the supply flow path 19 and the collection flow path 35 than in the normal case. When the power is turned on and when returning from sleep, there is a higher possibility that pigments and the like settle in the supply flow path 19 and the collection flow path 35 than in the normal case. Therefore, when the power is turned on and when returning from sleep, by circulating the liquid at a higher speed than in the normal case, it is possible to eliminate the air bubbles in the supply flow path 19 and the collection flow path 35 and increase the possibility of collecting the sedimentation.

Next, when the air bubble exhaust is performed from the nozzle 21B, the second positive pressure opening/closing valve 64B is open. As a result, by applying the second positive pressure to the liquid supplied from the supply flow path 19 and closing the collection flow path 35, the flow rate of the liquid discharged from the nozzle 21B of the liquid discharging head 21 from the supply flow path 19 can be efficiently increased. Therefore, the air bubbles in the nozzle 21B can be efficiently eliminated. Further, the time required for the liquid flow at a high speed can be shortened, and wasteful liquid can be reduced.

Next, when performing the wiping of the nozzle surface 21A, the first positive pressure opening/closing valve 64A and the second positive pressure opening/closing valve 64B are closed in the supply flow path 19, and the first negative pressure opening/closing valve 69A and the second negative pressure opening/closing valve 69B are closed in the collection flow path 35. As a result, the supply flow path 19 and the collection flow path 35 are closed. As described above, when the supply flow path 19 is closed, the unnecessary liquid does not flow from the supply flow path 19. Further, when the supply flow path 19 and the collection flow path 35 are closed, it is possible to reduce the discharge of the unnecessary liquid from the nozzle 21B by applying an upward force to the liquid in the liquid discharging head 21, and it is also possible to reduce the intrusion of liquid into the adjacent nozzle 21B.

Finally, during the neglecting time, the first negative pressure opening/closing valve 69A is open in the collection flow path 35. As a result, the supply flow path 19 is closed, and the unnecessary liquid does not flow from the supply flow path 19. During the neglecting time, the liquid discharging head 21 is in a capping state in which the cap 153 is in contact with the nozzle surface 21A. Further, by releasing the pressure of the nozzle 21B when the first negative pressure opening/closing valve 69A is open, it is possible to reduce the dripping of the liquid from the nozzle 21B due to the expansion of the liquid in the liquid discharging head 21 due to the environmental change such as the change in environmental temperature. Further, it is preferable that the first negative pressure opening/closing valve 69A is open in order to efficiently release the pressure of the nozzle 21B without flowing the unnecessary liquid from the supply flow path 19.

Further, the printing is performed on the medium by reciprocating the carriage 22 in the width direction X and discharging the liquid from the nozzle 21B of the liquid discharging head 21 while the carriage 22 is moving. As described above, when the carriage 22 reciprocates in the width direction X, the pressure is applied to the liquid stored in the liquid outflow portion 75 of the pressure adjustment device 60 according to the acceleration of the carriage 22 with respect to the width direction X. The liquid stored in the liquid outflow portion 75 is the liquid after the pressure is adjusted by the pressure adjustment device 60.

In the present embodiment, the liquid outflow portion 75 is provided at a position along a direction orthogonal to the width direction X and overlapping the plane passing through the liquid discharging head 21, and the flow path between the liquid outflow portion 75 and the liquid discharging head 21 is shortened with respect to the width direction X. When the flow path between the liquid outflow portion 75 and the liquid discharging head 21 is shortened with respect to the width direction X, the pressure applied according to the acceleration of the carriage 22 with respect to the width direction X becomes smaller. As described above, as the carriage 22 reciprocates in the width direction X, the external pressure applied to the liquid after the pressure is adjusted by the pressure adjustment device 60 can be reduced, and it is possible to reduce the pressure fluctuation of the liquid in the liquid discharging head 21.

The effects of the present embodiment will be described.

1. In the related art, it is necessary to dispose a pump for circulating liquid on at least any one of the flow paths of the supply flow path and the collection flow path, which may lead to an increase in size. Therefore, by using the first to third storage portions 41 to 43, the supply flow path 19, the first to third collection flow paths 35A to 35C, the first check valve 44, and the second check valve 45, for example, even when the pump is not provided on the flow path for circulating the liquid, it is possible to form the flow path for circulating the liquid, and miniaturization can be achieved.

2. In particular, by depressurizing the third storage portion 43, the liquid stored in the second storage portion 42 can be collected in the third storage portion 43 without causing the liquid stored in the first storage portion 41 to flow back to the third storage portion 43. Further, by pressurizing the third storage portion 43, the liquid can be collected in the first storage portion 41 without causing the liquid stored in the third storage portion 43 to flow back to the second storage portion 42. As a result, the liquid can be circulated without providing the pump on the flow path for circulating the liquid, and miniaturization can be achieved.

3. Further, by switching the depressurization switching portion 54 between the first depressurization state and the second depressurization state, it is possible to easily switch between depressurizing the second storage portion 42 and depressurizing the third storage portion 43. Further, by switching the pressurization switching portion 53 between the first pressurization state and the second pressurization state, it is possible to easily switch between pressurizing the first storage portion 41 and pressurizing the third storage portion 43.

4. The pressurization pump 51 capable of pressurizing each of the plurality of liquid circulation mechanisms 37 is shared. The depressurization pump 52 capable of depressurizing each of the plurality of liquid circulation mechanisms 37 is shared. Therefore, the size can be made smaller as compared with the configuration in which the pressurization pump 51 and the depressurization pump 52 are provided for each of the plurality of liquid circulation mechanisms 37.

5. When the first atmosphere opening portion 55A is open, in the third storage portion 43 capable of both pressurization by the pressurization pump 51 and depressurization by the depressurization pump 52, the flow paths 38C and 38F communicating with the depressurization switching portion 54 and the pressurization switching portion 53 can be open to the atmosphere. As a result, the pressurization and depressurization of the third storage portion 43 can be quickly switched.

6. By communicating the pressurization switching portion 53 and the replenishment storage portion 31 with each other via the first communication flow path 38B, the replenishment storage portion 31 is capable of being pressurized via the first communication flow path 38B, and the liquid of the replenishment storage portion 31 stored for the first storage portion 41 to be replenished can be pressurized.

7. By communicating the depressurization switching portion 54 and the replenishment storage portion 31 with each other via the second communication flow path 38J, the replenishment storage portion 31 is capable of being depressurized via the second communication flow path 38J. Therefore, by depressurizing the replenishment storage portion 31, the liquid from the liquid supply source 18 can be supplied to the replenishment storage portion 31.

8. In the replenishment storage portion 31 capable of both pressurization by the pressurization pump 51 and depressurization by the depressurization pump 52, it is possible to quickly switch between the pressurization and the depressurization of the replenishment storage portion 31 by opening the first communication flow path 38B to the atmosphere.

9. By the pressurization of the pressurization pump 51, the replenishment storage portion 31 can be pressurized via the first communication flow path 38B, and the first storage portion 41 can be pressurized via the first communication flow path 38B and the replenishment storage portion 31. As a result, the first storage portion 41 can be replenished with the liquid stored in the replenishment storage portion 31. Therefore, the pressurization pump 51 for implementing the replenishment of the first storage portion 41 with the liquid from the replenishment storage portion 31 and the supply of the liquid from the first storage portion 41 to the liquid discharging head 21, can also be used, and miniaturization can be achieved.

10. By the depressurization of the depressurization pump 52, the second storage portion 42 can be depressurized, and the replenishment storage portion 31 can be depressurized via the second storage portion 42 and the replenishment communication flow path 38H. As a result, the liquid can be sucked from the liquid supply source 18 to the replenishment storage portion 31. Therefore, the depressurization pump 52 for implementing the collection of the liquid from the liquid discharging head 21 to the second storage portion 42, the collection of the liquid from the second storage portion 42 to the third storage portion 43, and supply of the liquid from the liquid supply source 18 to the replenishment storage portion 31, can also be used, and miniaturization can be achieved.

11. Even when the second atmosphere opening portion 55B is open and the replenishment storage portion 31 is open to the atmosphere, the replenishment communication flow path 38H does not open unless the negative pressure on the second storage portion 42 side is lower than the predetermined negative pressure. Therefore, it is possible to prevent the second storage portion 42 from being open to the atmosphere by the replenishment storage portion 31 to open to the atmosphere.

12. By switching the state of the replenishment switching portion 58 between the first communication state and the second communication state, it is possible to easily switch whether or not the replenishment storage portion 31 is depressurized via the replenishment communication flow path 38H.

13. In a case where the replenishment storage portion 31 is not depressurized via the second communication flow path 38J by switching the state to the second communication state, in the first atmosphere communication path 38I that communicates with the second storage portion 42, the atmosphere can be sucked instead of sucking the liquid when the negative pressure of the second communication flow path 38J side is lower than the predetermined negative pressure.

14. When the positive pressure on the first storage portion 41 side is higher than the predetermined positive pressure, the second atmosphere communication path 38G communicating with the atmosphere is open by the pressurization opening portion 56. Therefore, it is possible to reduce the excessive pressurization of the first storage portion 41 in which the positive pressure on the first storage portion 41 side is higher than the predetermined positive pressure.

15. The circulation of the liquid can be performed by controlling the depressurization by the depressurization pump 52, the pressurization by the pressurization pump 51, the switching by the depressurization switching portion 54, and the switching by the pressurization switching portion 53.

16. When there is a first storage portion 41 in which the level of the liquid is lower than the predetermined height among the plurality of first storage portions 41, the liquid is collected from the plurality of third storage portions 43 in the plurality of first storage portions 41 including the first storage portion 41 in which the level of the liquid is not lower than the predetermined height among the plurality of first storage portions 41. Therefore, the number of times the pressurization pump 51 is driven can be reduced as compared with a configuration in which the liquid is not collected in the first storage portion 41 in which the level of the liquid is not lower than the predetermined height among the plurality of first storage portions 41, and aged deterioration of the pressurization portion can be reduced.

17. The time to switch the state of the pressurization switching portion 53 to the second pressurization state and collect the liquid from the third storage portion 43 to the first storage portion 41 is longer than the time to switch the state of the depressurization switching portion 54 to the second depressurization state and collect the liquid from the second storage portion 42 to the third storage portion 43. Therefore, the liquid stored in the second storage portion 42 can be easily collected in the first storage portion 41 via the third storage portion 43, and it is possible to easily recognize whether or not there is sufficient liquid collected from the liquid discharging head 21.

18. In the related art, the liquid is supplied at a constant flow rate in the supply flow path to the liquid discharging head, and the liquid is collected at a constant flow rate in the collection flow path from the liquid discharging head. Therefore, in the liquid circulation mechanism, it is desired to circulate the liquid at a flow rate according to the control status, such as a difference between the flow rate required for stable printing and the flow rate required for exhausting air bubbles. Therefore, it is possible to make different predetermined positive pressures for opening the flow paths in each of the first positive pressure supply flow path 62A and the second positive pressure supply flow path 62B that branch at the supply branch portion 61A in the supply flow path 19. The first positive pressure supply flow path 62A and the second positive pressure supply flow path 62B are configured such that the flow paths through which the liquid flows can be switched. Therefore, in the first positive pressure supply flow path 62A and the second positive pressure supply flow path 62B in which the positive pressures for opening the flow paths are different, the flow path through which the liquid flows can be selectively switched, and the liquid can be circulated at a flow rate according to the control status among a plurality of types of flow rates.

19. The first positive pressure opening/closing valve 64A and the second positive pressure opening/closing valve 64B provided in each of the first positive pressure supply flow path 62A and the second positive pressure supply flow path 62B in the supply flow path 19 can be controlled, and the flow path through which the liquid flows can be easily switched.

20. In the collection flow path 35, the predetermined negative pressure for opening the flow path can be made different in each of the first negative pressure collection flow path 67A and the second negative pressure collection flow path 67B branched at the collection branch portion 66A, and the flow paths through which the liquid flows are configured to be capable of being switched in the first negative pressure collection flow path 67A and the second negative pressure collection flow path 67B. Therefore, in the first negative pressure collection flow path 67A and the second negative pressure collection flow path 67B in which the negative pressures for opening the flow paths are different, the flow path through which the liquid flows can be selectively switched, and the liquid can be circulated at a flow rate according to the control status among a plurality of types of flow rates.

21. The first negative pressure opening/closing valve 69A and the second negative pressure opening/closing valve 69B provided in each of the first negative pressure collection flow path 67A and the second negative pressure collection flow path 67B in the collection flow path 35 can be controlled, and the flow path through which the liquid flows can be easily switched.

22. There is the first storage portion 41 for storing the liquid in the supply flow path 19, and the second storage portion 42 for storing the liquid in the collection flow path 35. Therefore, the liquid can be stored in both the supply flow path 19 and the collection flow path 35, and the liquid can be easily circulated.

23. Further, there is the first storage portion 41 at a connection portion of the supply flow path 19 to which the collection flow path 35 is coupled. Therefore, both the liquid supplied from the liquid supply source 18 and the liquid collected from the liquid discharging head 21 can be stored in the first storage portion 41, and the liquid can be easily circulated.

24. The pressurization pump 51, which is configured to be capable of pressurizing the first storage portion 41, and the depressurization pump 52, which is configured to be capable of depressurizing the second storage portion 42, are included, the liquid can be circulated by pressurizing/depressurizing the storage portions 41 and 42, and simplification of the flow path configuration can be achieved.

25. In the first storage portion 41 and the second storage portion 42, the liquid to be stored can be heated, and the liquid can be smoothly supplied by adjusting the viscosity of the liquid.

26. By mounting the liquid circulation mechanism 37 and the liquid discharging head 21 on the carriage 22 that is configured to be capable of reciprocating movement in the main scanning direction, a distance between the liquid circulation mechanism 37 and the liquid discharging head 21 can be shortened, and the flow path in the liquid discharging apparatus 10 can be easily routed.

27. By mounting the liquid circulation device 30 and the liquid discharging head 21 on the carriage 22, the distance between the liquid circulation device 30 and the liquid discharging head 21 can be shortened, and the flow path in the liquid discharging apparatus 10 can be easily routed.

28. Even when each of the pressure adjustment portions 63A, 63B, 68A, and 68B is mounted on the carriage 22, a distance of the flow path through which the liquid outflow portion 75 and the liquid discharging head 21 communicate with each other can be shortened with respect to the main scanning direction of the carriage 22. Therefore, it is possible to reduce the pressure fluctuation of the liquid in the flow path in which the liquid outflow portion 75 and the liquid discharging head 21 communicate with each other as the carriage 22 moves in the main scanning direction.

The present embodiment can be modified and performed as follows. The present embodiment and the following modification examples can be implemented in combination with each other within a technically consistent range.

Figure 15:
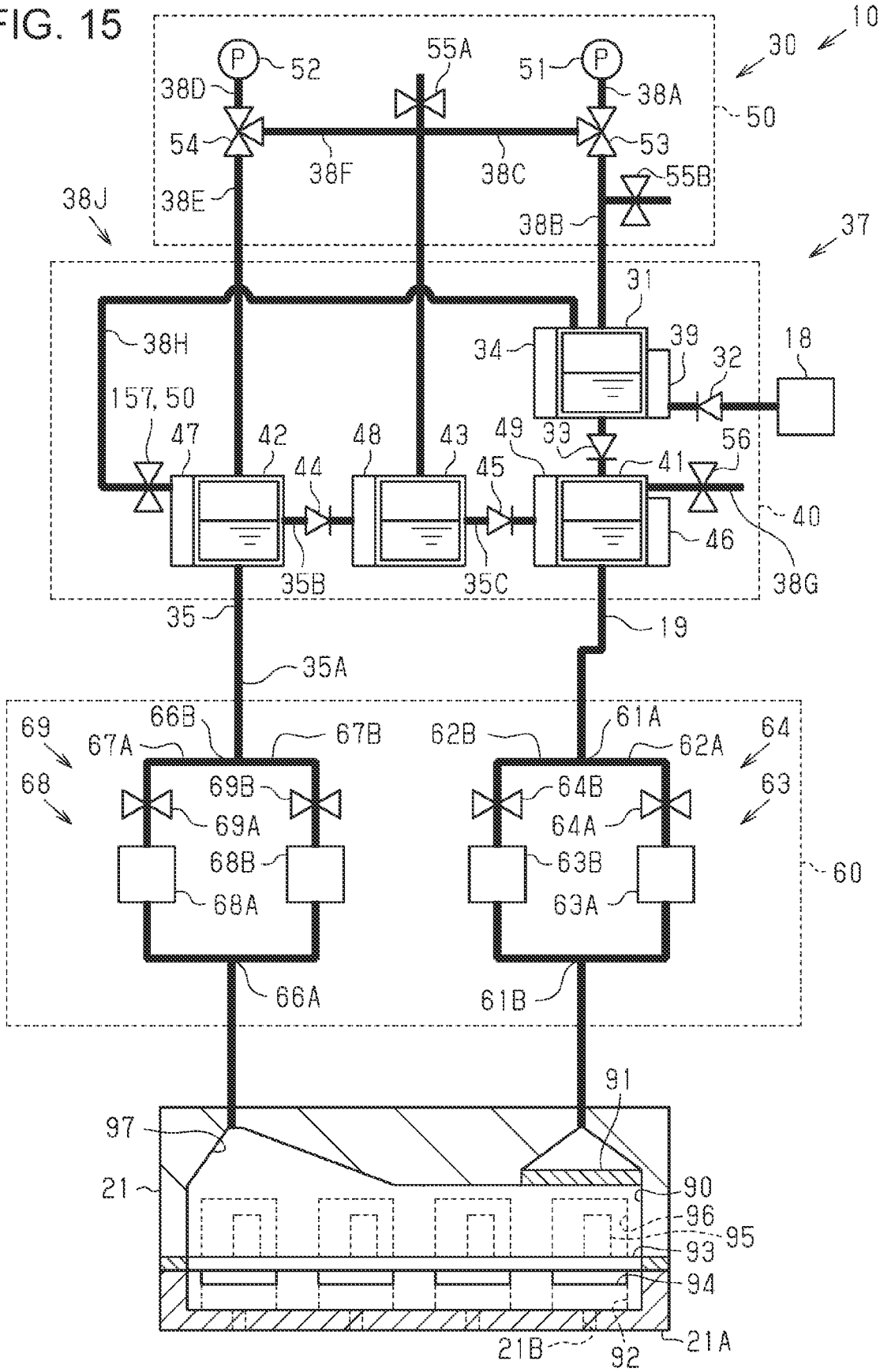
FIG. 15 is a schematic view illustrating an internal configuration of the liquid discharging apparatus.

In the above embodiment, for example, as illustrated in FIG. 15, the flow path opening/closing portion 157 may be provided in the replenishment communication flow path 38H instead of the first negative pressure opening portion 57, the replenishment switching portion 58, and the second negative pressure opening portion 59. The flow path opening/closing portion 157 includes a plurality of opening/closing portions so as to correspond to the type of liquid discharged from the liquid discharging head 21. Each of the plurality of flow path opening/closing portions 157 is an opening/closing valve configured to be capable of opening/closing the replenishment communication flow path 38H according to the instruction of the control portion 100. As described above, the circulation device 50 may include the flow path opening/closing portion 157 configured to be capable of opening/closing the replenishment communication flow path 38H. According to this configuration, even when the second atmosphere opening portion 55B is open and the replenishment storage portion 31 is open to the atmosphere, by closing the replenishment communication flow path 38H by the flow path opening/closing portion 157, the replenishment storage portion 31 and the second storage portion 42 do not communicate with each other. Therefore, it is possible to prevent the second storage portion 42 from being open to the atmosphere by the replenishment storage portion 31 to open to the atmosphere. Further, by opening/closing the replenishment communication flow path 38H by the flow path opening/closing portion 157, it is possible to easily switch whether or not the replenishment storage portion 31 is depressurized via the replenishment communication flow path 38H.

Figure 16:
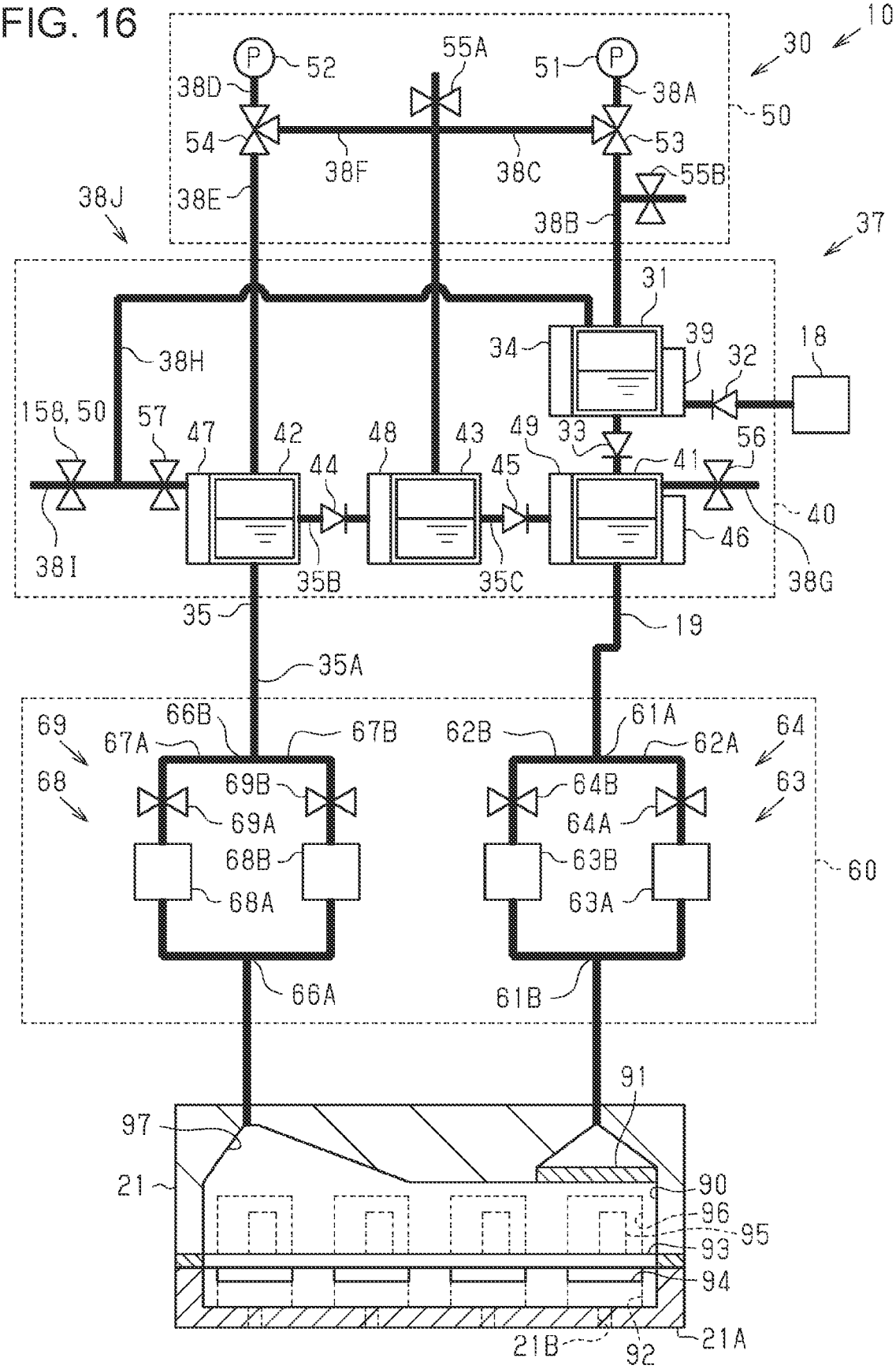
FIG. 16 is a schematic view illustrating an internal configuration of the liquid discharging apparatus.

In the above embodiment, for example, as illustrated in FIG. 16, the opening/closing portion 158 may be provided in the first atmosphere communication path 38I instead of the replenishment switching portion 58 and the second negative pressure opening portion 59. The opening/closing portion 158 is configured to be capable of opening/closing the first atmosphere communication path 38I. The opening/closing portion 158 includes a plurality of opening/closing portions so as to correspond to the type of liquid discharged from the liquid discharging head 21. Each of the plurality of opening/closing portions 158 is an opening/closing valve configured to be capable of opening/closing the replenishment communication flow path 38H according to the instruction of the control portion 100. As described above, the circulation device 50 includes the opening/closing portion 158. According to this configuration, by opening/closing the first atmosphere communication path 38I by the opening/closing portion 158, it is possible to easily switch whether or not the replenishment storage portion 31 is depressurized via the replenishment communication flow path 38H.

In the above embodiment, the first atmosphere opening portion 55A is coupled to the flow paths 38C and 38F, but the present disclosure is not limited to this. For example, the first atmosphere opening portion 55A may be coupled to the flow path 38C and may not be coupled to 38F. For example, the first atmosphere opening portion 55A may be coupled to the flow path 38F and may not be coupled to 38C. For example, the first atmosphere opening portion 55A may be coupled to the flow path coupled to the third storage portion 43, separately from the flow paths 38C and 38F. That is, the first atmosphere opening portion 55A only needs to be coupled to the flow path coupled to the third storage portion 43.

In the above embodiment, the second atmosphere opening portion 55B is coupled to the first communication flow path 38B, but the present disclosure is not limited to this. For example, the second atmosphere opening portion 55B may be coupled to the replenishment communication flow path 38H. That is, the second atmosphere opening portion 55B may be coupled to the second communication flow path 38J. Further, for example, the second atmosphere opening portion 55B may be coupled to both the first communication flow path 38B and the second communication flow path 38J. For example, the second atmosphere opening portion 55B may be coupled to the flow path coupled to the replenishment storage portion 31, separately from the first communication flow path 38B and the second communication flow path 38J. That is, the second atmosphere opening portion 55B may be configured to be capable of opening at least one of the first communication flow path 38B and the second communication flow path 38J to the atmosphere, and coupled to the flow path coupled to the replenishment storage portion 31.

In the above embodiment, for example, the liquid circulation device 30 may be provided with a plurality of at least any one of the pressurization pump 51, the depressurization pump 52, the pressurization switching portion 53, the depressurization switching portion 54, the first atmosphere opening portion 55A, and second atmosphere opening portion 55B so as to correspond to the type of liquid discharged from the liquid discharging head 21.

In the above embodiment, for example, the liquid circulation device 30 may include one replenishment switching portion 58 shared by the type of liquid discharged from the liquid discharging head 21. In this case, the replenishment switching portion 58 can switch the communication state for all types of liquid discharged from the liquid discharging head 21. Further, for example, in a case where the liquid is supplied from the plurality of liquid supply sources 18 to each of the plurality of replenishment storage portions 31, when the storage amount of liquid in at least any one of the plurality of replenishment storage portions 31 is equal to the third defined amount, the supply of the liquid with respect to all the plurality of replenishment storage portions 31 may be stopped.

In the above embodiment, for example, the liquid circulation device 30 may include a replenishment pump for supplying the liquid from the liquid supply source 18 to the first storage portion 41 via the supply flow path 19 instead of the replenishment storage portion 31. In this case, for example, the first communication flow path 38B is directly coupled to the first storage portion 41. Further, for example, the liquid circulation device 30 may not include the replenishment communication flow path 38H.

In the above embodiment, for example, the first time and the second time may be the same time and, for example, the first time may be longer than the second time.

In the above embodiment, for example, the state may be controlled to the first pressurization state and the second depressurization state over a predetermined first time. In this case, it is preferable that the second time is longer than the first time.

In the above embodiment, for example, after the storage amount of liquid stored in the replenishment storage portion 31 is equal to the third defined amount when the storage amount of liquid stored in the first storage portion 41 is equal to or less than the second defined amount in the next step, the liquid may not be supplied from the liquid supply source 18 to the replenishment storage portion 31 again. This is the content of the control in consideration of the situation in which the liquid stored in the replenishment storage portion 31 is not supplied to the first storage portion 41 yet. As a result, the number of times the replenishment switching portion 58 is switched can be reduced, and deterioration of the replenishment switching portion 58 due to switching of the replenishment switching portion 58 can be reduced.

In the above embodiment, for example, the third storage portion 43 may be a storage portion provided with a diaphragm. Specifically, the third storage portion 43 may include an air chamber and a liquid chamber partitioned by the diaphragm, the air chamber may communicate with the pressurization pump and the depressurization pump via each switching valve, and the liquid may be stored in the liquid chamber.

In the above embodiment, for example, a place where the collection flow path 35 is coupled to the supply flow path 19 may be the upstream of the first storage portion 41 instead of the first storage portion 41. That is, in the supply flow path 19, the first storage portion 41 may be provided on the liquid discharging head side from the connection portion to which the collection flow path 35 is coupled.

In the above embodiment, for example, the supply flow path 19 and the collection flow path 35 may be configured to branch into three or more flow paths. Further, for example, the pressure adjustment portions may be configured to open the three or more flow paths at different pressures, respectively.

In the above embodiment, for example, a branch portion, a plurality of flow paths, and a merging portion may be provided in any one of the supply flow path 19 between the first storage portion 41 and the liquid discharging head 21, and the collection flow path 35 between the liquid discharging head 21 and the second storage portion 42. That is, the branch portion, the plurality of flow paths, and the merging portion may be provided in at least one of the supply flow path 19 between the first storage portion 41 and the liquid discharging head 21, and the collection flow path 35 between the liquid discharging head 21 and the first storage portion 41.

In the above embodiment, for example, the pressure adjustment portion may be provided in any one of the supply flow path 19 and the collection flow path 35, and the pressure adjustment portion may not be provided on the other one thereof.

In the above embodiment, for example, the positive pressure opening/closing valve 64 may be provided downstream of the positive pressure adjustment portion 63 in the supply flow path 19. Further, for example, the negative pressure opening/closing valve 69 may be provided upstream of the negative pressure adjustment portion 68 in the collection flow path 35.

In the above embodiment, for example, the opening/closing valve may not be provided in each of the plurality of branched flow paths. In this case, for example, a flow path switching portion for switching which flow path of the plurality of flow paths to open may be provided in the branch portion. Further, for example, a flow path switching portion for switching which flow path of the plurality of flow paths to open may be provided in the merging portion.

In the above embodiment, for example, the first storage amount detection portion 46 may include at least one of a lower limit sensor that detects that the storage amount of liquid is equal to or less than the first defined amount and a replenishment determination sensor that detects that the storage amount of liquid is equal to or less than the second defined amount.

In the above embodiment, for example, the first storage amount detection portion 46 and the replenishment storage amount detection portion 39 may be float sensors. In this case, the first storage portion 41 and the replenishment storage portion 31 may have a shape in which the dimension in the vertical direction Z is longer than the dimension in the horizontal direction. As a result, the displacement amount of the float with respect to the change in storage amount of liquid can be increased, and the detection accuracy of the first storage amount detection portion 46 and the replenishment storage amount detection portion 39 is improved.

In the above embodiment, for example, the temperature adjustment portion may have a different mode of heating the liquid depending on the situation. For example, the first temperature adjustment portion 47 may heat the liquid with the liquid being supplied from the liquid supply source 18 to the first storage portion 41 as an opportunity. For example, the first temperature adjustment portion 47 may heat the liquid with the liquid being collected from the third storage portion 43 to the first storage portion 41. In particular, the first storage portion 41 is provided in a flow path close to the liquid discharging head 21 and can heat the liquid supplied to or collected in the first storage portion 41. Therefore, even when the liquid having a low temperature is supplied to or collected in the first storage portion 41, it is possible to efficiently heat the liquid before it is supplied to the liquid discharging head 21, and it is possible to reduce a sudden temperature change of the liquid. Further, for example, each temperature adjustment portion may heat the liquid based on various parameters. The various parameters include at least any one of the operating statuses such as the continuous operation time of the liquid discharging apparatus 10, the actual temperature of the liquid, the environmental temperature set in the liquid discharging apparatus 10, and the storage amount of liquid stored in the storage portion. In this case, the liquid circulation mechanism 37 may include types of sensors that detect the actual temperature of the liquid and the environmental temperature set in the liquid discharging apparatus 10. Further, for example, each temperature adjustment portion may adjust the amount of heat for heating the liquid by changing the duty ratio of the heating value based on the various parameters described above. Further, for example, the control portion may control each temperature adjustment portion by predicting the amount of heat based on the various parameters described above.

In the above embodiment, for example, when the temperature adjustment portion is provided in the first storage portion 41, which is provided in the flow path close to the liquid discharging head 21, the temperature adjustment portion may not be provided in at least any one of the second storage portion 42, the third storage portion 43, and the replenishment storage portion 31. Further, for example, the temperature adjustment portion may not be provided in the first storage portion 41.

In the above embodiment, the temperature adjustment portion may be provided in at least any one of the supply flow path 19 and the pressure adjustment portion.

In the above embodiment, the pressure adjustment device 60, the liquid outflow portion 75, and the liquid inflow portion 84 are disposed in the vertical direction Z of the liquid discharging head 21, but the present disclosure is not limited to this. The pressure adjustment device 60, the liquid outflow portion 75, and the liquid inflow portion 84 may not be disposed in the vertical direction Z of the liquid discharging head 21 as long as the pressure adjustment device 60, the liquid outflow portion 75, and the liquid inflow portion 84 are along the direction orthogonal to the width direction X in order to shorten the flow path in the width direction X and provided at positions overlapping the plane passing through the liquid discharging head 21, for example.

In the above embodiment, for example, the liquid supply source 18 may be mounted on the carriage 22. Further, for example, at least a part of the configuration of the liquid circulation device 30 may not be mounted on the carriage 22.

In the above embodiment, for example, when the air bubble exhaust is performed from the nozzle 21B, a suction cleaning may be performed. The suction cleaning is a cleaning in which the liquid in the nozzle 21B is sucked from the nozzle surface 21A side and the liquid is discharged from the nozzle 21B. For example, when the air bubble exhaust is performed from the nozzle 21B, a pressurization cleaning may be performed. In the pressurization cleaning, the liquid is discharged from the nozzle 21B by pressurizing the liquid in the liquid discharging head 21. Further, for example, when the air bubble exhaust is performed from the nozzle 21B, a flushing may be performed.

In the above embodiment, for example, the ink may be any ink that can be printed on the medium M by adhering to the medium M. Specifically, the ink includes, for example, substance, in which particles of a functional material made of a solid substance such as a pigment or metal particles dissolved, dispersed, or mixed in a solvent, and various compositions such as water-based ink, oil-based ink, gel ink, and hot melt ink. Further, for example, the liquid may be other than ink as long as it can be printed on the medium M by adhering to the medium M.

In the above embodiment, the medium M may be, for example, paper, synthetic resin, metal, cloth, ceramic, rubber, or a composite thereof.

In the above embodiment, the liquid discharging apparatus 10 may be an apparatus that prints by discharging the liquid onto the medium M. The liquid discharging apparatus 10 may be, for example, a serial printer, a lateral printer, a line printer, a page printer, an offset printing apparatus, a dyeing printing apparatus, or the like.

In the following, the technical ideas and the operational effects ascertained from the above-described embodiments and modification examples will be described.

A liquid circulation mechanism includes: a first storage portion configured to store liquid to be supplied to a liquid discharging head that discharges the liquid; a supply flow path making the first storage portion and the liquid discharging head communicate with each other; a second storage portion configured to store the liquid collected from the liquid discharging head; a first collection flow path making the liquid discharging head and the second storage portion communicate with each other; a third storage portion configured to store the liquid between the second storage portion and the first storage portion; a second collection flow path making the second storage portion and the third storage portion communicate with each other; a third collection flow path making the third storage portion and the first storage portion communicate with each other; a first check valve allowing flow of the liquid from the second storage portion to the third storage portion while regulating flow of the liquid from the third storage portion to the second storage portion, in the second collection flow path; and a second check valve allowing flow of the liquid from the third storage portion to the first storage portion while regulating flow of the liquid from the first storage portion to the third storage portion, in the third collection flow path.

According to this configuration, by using the first to third storage portions, the supply flow path, the first to third collection flow paths, the first check valve, and the second check valve, for example, even when the pump is not provided on the flow path for circulating the liquid, it is possible to form the flow path for circulating the liquid, and miniaturization can be achieved.

A liquid circulation device includes: a liquid circulation mechanism having a first storage portion configured to store liquid to be supplied to a liquid discharging head that discharges the liquid, a supply flow path making the first storage portion and the liquid discharging head communicate with each other, a second storage portion configured to store the liquid collected from the liquid discharging head, a first collection flow path making the liquid discharging head and the second storage portion communicate with each other, a third storage portion configured to store the liquid between the second storage portion and the first storage portion, a second collection flow path making the second storage portion and the third storage portion communicate with each other, a third collection flow path making the third storage portion and the first storage portion communicate with each other, a first check valve allowing flow of the liquid from the second storage portion to the third storage portion while regulating flow of the liquid from the third storage portion to the second storage portion, in the second collection flow path, and a second check valve allowing flow of the liquid from the third storage portion to the first storage portion while regulating flow of the liquid from the first storage portion to the third storage portion, in the third collection flow path; and a circulation device having a depressurization portion configured to depressurize the second storage portion and the third storage portion, a depressurization switching portion configured to switch at least between a first depressurization state, in which the depressurization portion and the second storage portion communicate with each other, and a second depressurization state, in which the depressurization portion and the third storage portion communicate with each other, a pressurization portion configured to pressurize the third storage portion and the first storage portion, and a pressurization switching portion configured to switch at least between a first pressurization state, in which the pressurization portion and the first storage portion communicate with each other, and a second pressurization state, in which the pressurization portion and the third storage portion communicate with each other.

According to this configuration, by using the first to third storage portions, the supply flow path, the first to third collection flow paths, the first check valve, and the second check valve, for example, even when the pump is not provided on the flow path for circulating the liquid, it is possible to form the flow path for circulating the liquid, and miniaturization can be achieved.

Further, by depressurizing the third storage portion, the liquid stored in the second storage portion can be collected in the third storage portion without causing the liquid stored in the first storage portion to flow back to the third storage portion. Further, by pressurizing the third storage portion, the liquid can be collected in the first storage portion without causing the liquid stored in the third storage portion to flow back to the second storage portion. As a result, the liquid can be circulated without providing the pump on the flow path for circulating the liquid, and miniaturization can be achieved.

Further, by switching the depressurization switching portion between the first depressurization state and the second depressurization state, it is possible to easily switch between depressurizing the second storage portion and depressurizing the third storage portion. Further, by switching the pressurization switching portion between the first pressurization state and the second pressurization state, it is possible to easily switch between pressurizing the first storage portion and pressurizing the third storage portion.

In the liquid circulation device, a plurality of the liquid circulation mechanisms may be provided, in which each of the plurality of liquid circulation mechanisms may be configured to be pressurized by the shared pressurization portion, and be depressurized by the shared depressurization portion.

According to this configuration, the pressurization portion capable of pressurizing each of the plurality of liquid circulation mechanisms is shared. The depressurization portion capable of depressurizing each of the plurality of liquid circulation mechanisms is shared. Therefore, the size can be made smaller as compared with the configuration in which the pressurization portion and the depressurization portion are included for each of the plurality of liquid circulation mechanisms.

In the liquid circulation device, the circulation device may have a first atmosphere opening portion configured to open a flow path, which makes the third storage portion communicate with the depressurization switching portion and the pressurization switching portion, to atmosphere.

According to this configuration, in the third storage portion capable of both pressurization by the pressurization portion and depressurization by the depressurization portion, by opening the flow path, which communicates with the depressurization switching portion and the pressurization switching portion, to the atmosphere, it is possible to quickly switch between the pressurization and the depressurization of the third storage portion.

In the liquid circulation device, the liquid circulation mechanism may have a replenishment storage portion that stores the liquid with which the first storage portion is replenished, and a first communication flow path that makes the pressurization switching portion and the replenishment storage portion communicate with each other.

According to this configuration, by communicating the pressurization switching portion and the replenishment storage portion with each other via the first communication flow path, the replenishment storage portion is capable of being pressurized via the first communication flow path, and the liquid of the replenishment storage portion stored for the first storage portion to be replenished can be pressurized.

In the liquid circulation device, the replenishment storage portion may be configured to store the liquid supplied from the liquid supply source, and the liquid circulation mechanism may have a second communication flow path that makes the depressurization switching portion and the replenishment storage portion communicate with each other.

According to this configuration, by communicating the depressurization switching portion and the replenishment storage portion with each other via the second communication flow path, the replenishment storage portion is capable of being depressurized via the second communication flow path, and the liquid from the liquid supply source can be supplied to the replenishment storage portion by depressurizing the replenishment storage portion.

In the liquid circulation device, the circulation device may have a second atmosphere opening portion configured to open at least one of the first communication flow path and the second communication flow path, to atmosphere.

According to this configuration, in the replenishment storage portion capable of both pressurization by the pressurization portion and depressurization by the depressurization portion, by opening at least one of the first communication flow path and the second communication flow path to the atmosphere, it is possible to quickly switch between the pressurization and the depressurization of the replenishment storage portion.

In the liquid circulation device, the first storage portion may communicate with the pressurization portion via the replenishment storage portion.

According to this configuration, by pressurizing the pressurization portion, the replenishment storage portion can be pressurized via the first communication flow path, the first storage portion can be pressurized via the first communication flow path and the replenishment storage portion, and the first storage portion can be replenished with the liquid stored in the replenishment storage portion. Therefore, the pressurization portion for implementing the replenishment of the first storage portion with the liquid from the replenishment storage portion and the supply of the liquid from the first storage portion to the liquid discharging head, can also be used, and miniaturization can be achieved.

In the liquid circulation device, the second communication flow path may include a replenishment communication flow path that makes the second storage portion and the replenishment storage portion communicate with each other.

According to this configuration, by depressurizing the depressurization portion, the second storage portion can be depressurized, the replenishment storage portion can be depressurized via the second storage portion and the replenishment communication flow path, and the liquid can be sucked from the liquid supply source in the replenishment storage portion. Therefore, the depressurization portion for implementing the collection of the liquid from the liquid discharging head to the second storage portion, the collection of the liquid from the second storage portion to the third storage portion, and supply of the liquid from the liquid supply source to the replenishment storage portion, can also be used, and miniaturization can be achieved.

In the liquid circulation device, the liquid circulation mechanism may have a first negative pressure opening portion that opens the replenishment communication flow path when a negative pressure on the second storage portion side is lower than a predetermined negative pressure, in the replenishment communication flow path.

According to this configuration, even when the second atmosphere opening portion is open and the replenishment storage portion is open to the atmosphere, the replenishment communication flow path does not open unless the negative pressure on the second storage portion side is lower than the predetermined negative pressure. Therefore, it is possible to prevent the second storage portion from being open to the atmosphere by the replenishment storage portion to open to the atmosphere.

In the liquid circulation device, the liquid circulation mechanism may have a first atmosphere communication path that communicates with atmosphere, in the replenishment communication flow path, and the circulation device may have a replenishment switching portion configured to switch between a first communication state in which the second storage portion and the replenishment storage portion communicate with each other, and a second communication state in which the second storage portion and the first atmosphere communication path communicate with each other.

According to this configuration, by switching the state of the replenishment switching portion between the first communication state and the second communication state, it is possible to easily switch whether or not the replenishment storage portion is depressurized via the replenishment communication flow path.

In the liquid circulation device, the liquid circulation mechanism may have a second negative pressure opening portion that opens the first atmosphere communication path when a negative pressure on the second communication flow path side is lower than a predetermined negative pressure, in the first atmosphere communication path.

According to this configuration, in a case where the replenishment storage portion is not depressurized via the second communication flow path by switching the state to the second communication state, in the first atmosphere communication path that communicates with the second storage portion, the atmosphere can be sucked instead of sucking the liquid when the negative pressure of the second communication flow path side is lower than the predetermined negative pressure.

In the liquid circulation device, the circulation device may have a flow path opening/closing portion configured to open and close the replenishment communication flow path.

According to this configuration, even when the second atmosphere opening portion is open and the replenishment storage portion is open to the atmosphere, by closing the replenishment communication flow path by the flow path opening/closing portion, the replenishment storage portion and the second storage portion do not communicate with each other. Therefore, it is possible to prevent the second storage portion from being open to the atmosphere by the replenishment storage portion to open to the atmosphere. Further, by opening/closing the replenishment communication flow path by the flow path opening/closing portion, it is possible to easily switch whether or not the replenishment storage portion is depressurized via the replenishment communication flow path.

In the liquid circulation device, the liquid circulation mechanism may have a first atmosphere communication path that communicates with atmosphere, and the circulation device may have an opening/closing portion configured to open and close the first atmosphere communication path, in the replenishment communication flow path.

According to this configuration, by opening/closing the first atmosphere communication path by the opening/closing portion, it is possible to easily switch whether or not the replenishment storage portion is depressurized via the replenishment communication flow path.

In the liquid circulation device, the liquid circulation mechanism may have a second atmosphere communication path that is provided in the first storage portion and communicates with atmosphere, and a pressurization opening portion that is provided in the second atmosphere communication path and opens the second atmosphere communication path when a positive pressure on the first storage portion side is higher than a predetermined positive pressure.

According to this configuration, when the positive pressure on the first storage portion side is higher than the predetermined positive pressure, the second atmosphere communication path communicating with the atmosphere is open by the pressurization opening portion. Therefore, it is possible to reduce the excessive pressurization of the first storage portion in which the positive pressure on the first storage portion side is higher than the predetermined positive pressure.

A liquid discharging apparatus includes a liquid discharging head that discharges liquid, the liquid circulation device described above, and a control portion that controls the liquid discharging head and the liquid circulation device.

According to this configuration, the same effect as that of the liquid circulation device above described is obtained.

In the liquid discharging apparatus, the control portion may circulate the liquid by controlling depressurization by the depressurization portion, pressurization by the pressurization portion, switching by the depressurization switching portion, and switching by the pressurization switching portion.

According to this configuration, the circulation of the liquid can be performed by controlling the depressurization by the depressurization portion, the pressurization by the pressurization portion, the switching by the depressurization switching portion, and the switching by the pressurization switching portion.

In the liquid discharging apparatus, a plurality of the liquid circulation mechanisms may be provided, in which each of the plurality of liquid circulation mechanisms may be configured to be pressurized by the shared pressurization portion, and during pressurization of a plurality of the first storage portions by the pressurization portion, when there is a first storage portion in which a level of the liquid is lower than a predetermined height among the plurality of first storage portions, the control portion may switch a state of the pressurization switching portion to the second pressurization state in which the pressurization portion and a plurality of the third storage portions communicate with each other.

According to this configuration, when there is a first storage portion in which the level of the liquid is lower than the predetermined height among the plurality of first storage portions, the liquid is collected from the plurality of third storage portions in the plurality of first storage portions including the first storage portion in which the level of the liquid is not lower than the predetermined height among the plurality of first storage portions. Therefore, the number of times the pressurization portion is driven can be reduced as compared with a configuration in which the liquid is not collected in the first storage portion in which the level of the liquid is not lower than the predetermined height among the plurality of first storage portions, and aged deterioration of the pressurization portion can be reduced.

In the liquid discharging apparatus, the control portion may switch a state of the depressurization switching portion to the second depressurization state, in which the depressurization portion and the third storage portion communicate with each other, and depressurize the third storage portion over a first time in the second depressurization state, and thereafter may switch a state of the pressurization switching portion to the second pressurization state, in which the pressurization portion and the third storage portion communicate with each other, and pressurize the third storage portion over a second time, which is longer than the first time, in the second pressurization state.

According to this configuration, the time to switch the state of the pressurization switching portion to the second pressurization state and collect the liquid from the third storage portion to the first storage portion is longer than the time to switch the state of the depressurization switching portion to the second depressurization state and collect the liquid from the second storage portion to the third storage portion. Therefore, the liquid stored in the second storage portion can be easily collected in the first storage portion via the third storage portion, and it is possible to easily recognize whether or not there is sufficient liquid collected from the liquid discharging head.

What is claimed is:

1. A liquid circulation mechanism comprising:

a first storage portion configured to store liquid to be supplied to a liquid discharging head that discharges the liquid;

a supply flow path that communicates the first storage portion and the liquid discharging head;

a second storage portion configured to store the liquid collected from the liquid discharging head;

a first collection flow path that communicates the liquid discharging head and the second storage portion;

a third storage portion configured to store the liquid and provided between the second storage portion and the first storage portion;

a second collection flow path that communicates the second storage portion and the third storage portion;

a third collection flow path that communicates the third storage portion and the first storage portion;

a first check valve provided in the second collection flow path, the first check valve being configured to allow flow of the liquid from the second storage portion to the third storage portion and regulate flow of the liquid from the third storage portion to the second storage portion; and a second check valve provided in the third collection flow path, the second check valve being configured to allow flow of the liquid from the third storage portion to the first storage portion and regulate flow of the liquid from the first storage portion to the third storage portion.

2. A liquid circulation device comprising:

a liquid circulation mechanism having a first storage portion configured to store liquid to be supplied to a liquid discharging head that discharges the liquid, a supply flow path that communicates the first storage portion and the liquid discharging head, a second storage portion configured to store the liquid collected from the liquid discharging head, a first collection flow path that communicates the liquid discharging head and the second storage portion, a third storage portion configured to store the liquid and provided between the second storage portion and the first storage portion, a second collection flow path communicates the second storage portion and the third storage portion, a third collection flow path communicates the third storage portion and the first storage portion, a first check valve provided in the second collection flow path, the first check valve being configured to allow flow of the liquid from the second storage portion to the third storage portion and regulate flow of the liquid from the third storage portion to the second storage portion, and a second check valve provided in the third collection flow path, the second check valve being configured to allow flow of the liquid from the third storage portion to the first storage portion and regulate flow of the liquid from the first storage portion to the third storage portion; and a circulation device having a depressurization portion configured to depressurize the second storage portion and the third storage portion, a depressurization switching portion configured to switch at least between a first depressurization state, in which the depressurization portion and the second storage portion communicate with each other, and a second depressurization state, in which the depressurization portion and the third storage portion communicate with each other, a pressurization portion configured to pressurize the third storage portion and the first storage portion, and a pressurization switching portion configured to switch at least between a first pressurization state, in which the pressurization portion and the first storage portion communicate with each other, and a second pressurization state, in which the pressurization portion and the third storage portion communicate with each other.

3. The liquid circulation device according to claim 2, wherein, a plurality of the liquid circulation mechanisms are provided, and the plurality of liquid circulation mechanisms are configured to be pressurized by the shared pressurization portion, and be depressurized by the shared depressurization portion.

4. The liquid circulation device according to claim 2, wherein the circulation device has a first atmosphere opening portion configured to open a flow path, that communicates the third storage portion, the depressurization switching portion and the pressurization switching portion, to atmosphere.

5. The liquid circulation device according to claim 2, wherein the liquid circulation mechanism has a replenishment storage portion that stores the liquid with which the first storage portion is replenished, and a first communication flow path that communicates the pressurization switching portion and the replenishment storage portion.

6. The liquid circulation device according to claim 5, wherein the replenishment storage portion is configured to store the liquid supplied from a liquid supply source, and the liquid circulation mechanism has a second communication flow path that communicates the depressurization switching portion and the replenishment storage portion.

7. The liquid circulation device according to claim 6, wherein the circulation device has a second atmosphere opening portion configured to open at least one of the first communication flow path and the second communication flow path, to atmosphere.

8. The liquid circulation device according to claim 5, wherein the first storage portion communicates with the pressurization portion via the replenishment storage portion.

9. The liquid circulation device according to claim 6, wherein the second communication flow path includes a replenishment communication flow path that communicates the second storage portion and the replenishment storage portion.

10. The liquid circulation device according to claim 9, wherein the liquid circulation mechanism has a first negative pressure opening portion that opens the replenishment communication flow path when a negative pressure on the second storage portion side is lower than a predetermined negative pressure, in the replenishment communication flow path.

11. The liquid circulation device according to claim 9, wherein the liquid circulation mechanism has a first atmosphere communication path that communicates with atmosphere, in the replenishment communication flow path, and the circulation device has a replenishment switching portion configured to switch between a first communication state in which the second storage portion and the replenishment storage portion communicate with each other, and a second communication state in which the second storage portion and the first atmosphere communication path communicate with each other.

12. The liquid circulation device according to claim 11, wherein the liquid circulation mechanism has a second negative pressure opening portion that opens the first atmosphere communication path when a negative pressure on the second communication flow path side is lower than a predetermined negative pressure, in the first atmosphere communication path.

13. The liquid circulation device according to claim 9, wherein the circulation device has a flow path opening/closing portion configured to open and close the replenishment communication flow path.

14. The liquid circulation device according to claim 9, wherein the liquid circulation mechanism has a first atmosphere communication path that communicates with atmosphere, in the replenishment communication flow path, and the circulation device has an opening/closing portion configured to open and close the first atmosphere communication path.

15. The liquid circulation device according to claim 2, wherein the liquid circulation mechanism has a second atmosphere communication path that is provided in the first storage portion and communicates with atmosphere, and a pressurization opening portion that is provided in the second atmosphere communication path and opens the second atmosphere communication path when a positive pressure on the first storage portion side is higher than a predetermined positive pressure.

16. A liquid discharging apparatus comprising: a liquid discharging head discharging liquid;

the liquid circulation device according to claim 2; and a control portion controlling the liquid discharging head and the liquid circulation device.

17. The liquid discharging apparatus according to claim 16, wherein the control portion circulates the liquid by controlling depressurization by the depressurization portion, pressurization by the pressurization portion, switching by the depressurization switching portion, and switching by the pressurization switching portion.

18. The liquid discharging apparatus according to claim 16, wherein, a plurality of the liquid circulation mechanisms are provided, the plurality of liquid circulation mechanisms are configured to be pressurized by the shared pressurization portion, and during pressurization of a plurality of the first storage portions by the pressurization portion, when there is a first storage portion in which a level of the liquid is lower than a predetermined height among the plurality of first storage portions, the control portion switches a state of the pressurization switching portion to the second pressurization state in which the pressurization portion and a plurality of the third storage portions communicate with each other.

19. The liquid discharging apparatus according to claim 16, wherein the control portion switches a state of the depressurization switching portion to the second depressurization state, in which the depressurization portion and the third storage portion communicate with each other, and depressurizes the third storage portion over a first time in the second depressurization state, and thereafter switches a state of the pressurization switching portion to the second pressurization state, in which the pressurization portion and the third storage portion communicate with each other, and pressurizes the third storage portion over a second time, which is longer than the first time, in the second pressurization state.

* * * * *